US012270276B2

(12) United States Patent
Wakefield

(10) Patent No.: US 12,270,276 B2
(45) Date of Patent: Apr. 8, 2025

(54) INFLOW CONTROL DEVICE, METHOD, AND SYSTEM

(71) Applicant: Baker Hughes Oilfield Operations LLC, Houston, TX (US)

(72) Inventor: John Wakefield, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/464,496

(22) Filed: Sep. 11, 2023

(65) Prior Publication Data

US 2025/0084725 A1 Mar. 13, 2025

(51) Int. Cl.
*E21B 34/06* (2006.01)

(52) U.S. Cl.
CPC ..... *E21B 34/06* (2013.01)

(58) Field of Classification Search
None
See application file for complete search history.

(56) References Cited

U.S. PATENT DOCUMENTS

| | | | | |
|---|---|---|---|---|
| 7,942,206 | B2 | 5/2011 | Huang et al. | |
| 9,506,320 | B2 | 11/2016 | Dykstra et al. | |
| 10,145,223 | B2 | 12/2018 | Moen et al. | |
| 10,689,268 | B1 * | 6/2020 | Jamison | C02F 1/44 |
| 11,111,756 | B2 | 9/2021 | Killie et al. | |
| 11,613,961 | B2 | 3/2023 | Malkawi et al. | |
| 2013/0014944 | A1 * | 1/2013 | Mazyar | E21B 43/385 977/902 |
| 2014/0048282 | A1 * | 2/2014 | Dykstra | E21B 43/08 166/373 |
| 2015/0361773 | A1 * | 12/2015 | Agrawal | E21B 41/02 166/228 |
| 2017/0074145 | A1 * | 3/2017 | Silvis | B01F 25/40 |
| 2019/0040714 | A1 * | 2/2019 | Fripp | E21B 43/084 |
| 2020/0095851 | A1 * | 3/2020 | Stojkovic | E21B 43/12 |
| 2021/0180440 | A1 * | 6/2021 | Lo Cascio | E21B 33/124 |
| 2022/0121124 | A1 * | 4/2022 | Van Elten | G03F 7/709 |
| 2022/0162936 | A1 * | 5/2022 | DiFoggio | E21B 43/38 |
| 2023/0075579 | A1 * | 3/2023 | Snitkoff | F16L 55/02754 |

* cited by examiner

*Primary Examiner* — Taras P Bemko
(74) *Attorney, Agent, or Firm* — Baker Hughes Patent Organization

(57) ABSTRACT

An inflow control device includes a first flow control structure that is porous and forms differing flowpaths for water and oil. A method of controlling flow includes flowing a fluid from a source to a destination through the inflow control device, and controlling flow via the first flow control structure such that oil flows through the inflow control device more easily than water. A method of controlling flow includes flowing a fluid from a source to a destination through the inflow control device, and flowing a portion of water in the fluid through the first flow control structure to impinge on an upstream surface of the second flow control structure. A wellbore system includes a borehole in a subsurface formation, a string disposed in the borehole, and the inflow control device disposed within or as part of the string.

22 Claims, 27 Drawing Sheets

INFLOW CONTROL DEVICE, METHOD, AND SYSTEM

BACKGROUND

In the resource recovery and fluid sequestration industries, especially in mature wells, the target fluid may include a greater percentage of water than might be desired. Inflow control devices may be disposed in the well to exclude higher water percentage fluids while allowing lower water percentage fluids to flow into the borehole.

SUMMARY

According to one or more embodiments, an inflow control device includes a first flow control structure that is porous and forms differing flowpaths for water and oil.

According to one or more embodiments, a method of controlling flow includes flowing a fluid from a source to a destination through the inflow control device, and controlling flow via the first flow control structure such that oil flows through the inflow control device more easily than water.

According to one or more embodiments, a method of controlling flow includes flowing a fluid from a source to a destination through the inflow control device, and flowing a portion of water in the fluid through the first flow control structure to impinge on an upstream surface of the second flow control structure.

According to one or more embodiments, a wellbore system includes a borehole in a subsurface formation, a string disposed in the borehole, and the inflow control device disposed within or as part of the string.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
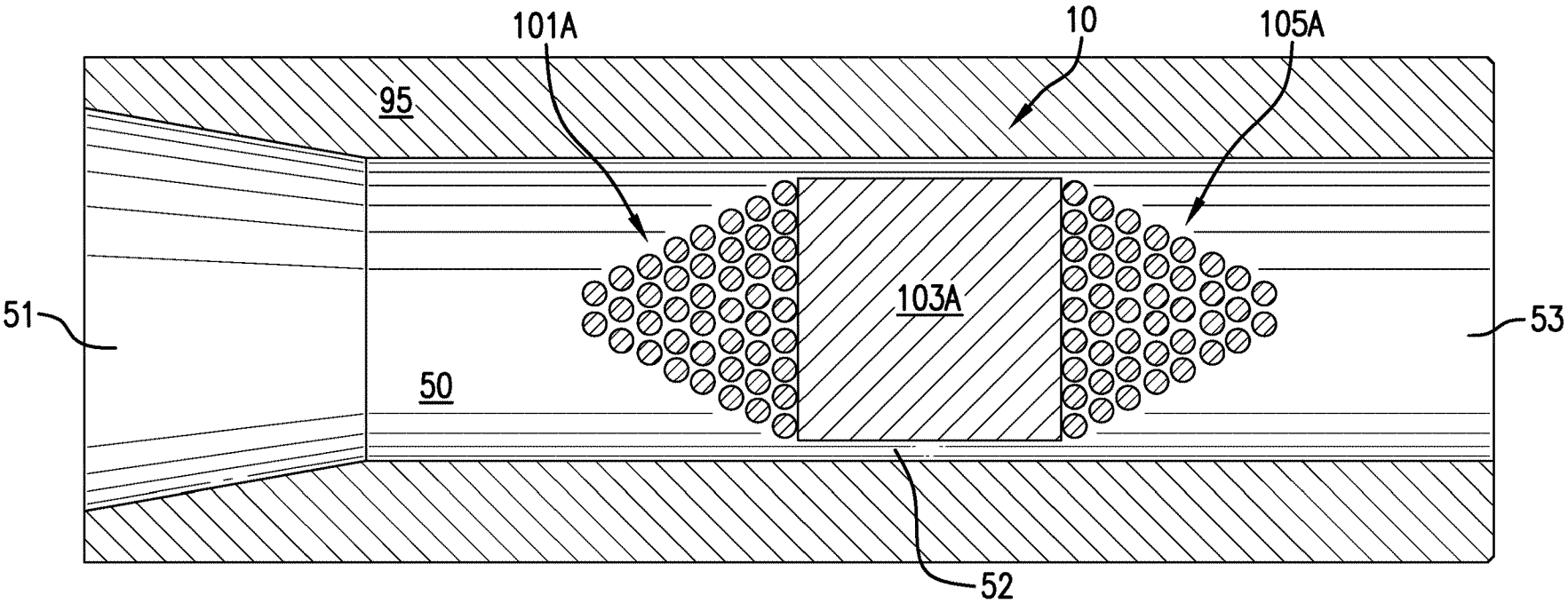
FIG. 1A is a schematic view of an inflow control device according to an embodiment.

A detailed description of one or more embodiments of the disclosed apparatus and method are presented herein by way of exemplification and not limitation with reference to the Figures.

FIGS. 1A-9C illustrate embodiments of an inflow control device 10. A housing 95 may be disposed within or may form part of a string 90 of a borehole system 70 (see FIG. 11). The housing 95 defines a flowpath 50 therein, including an inlet 51 and an outlet 53. The flowpath 50 may extend, in an embodiment, from an outer surface of a wall of the string 90 to an inner surface of the wall of the string 90 in a radial direction thereof, for example, orthogonally or at another angle relative to a longitudinal axis of string 90. Alternatively, the flowpath 50 may run within an inside diameter (I.D.) of the string 90. In other embodiments, the flowpath 50 may be formed in alternate structure that is connected to the string 90. Fluid extracted from a formation 20 (see FIG. 11), which may be a mixture of oil 30 and water 40, enters the flowpath 50 from the inlet 51 and exits the flowpath 50 from the outlet 53.

Referring to FIG. 1A, an inflow control device 10 according to an embodiment is illustrated. The inflow control device 10 includes a leading edge flow control structure 101A, an intermediate flow control structure 103A, and a trailing edge flow control structure 105A. A throat 52 of the flowpath 50 is defined between an outer surface of the intermediate flow control structure 103A and an inner surface of the housing 95. According to one or more embodiments, the throat 52 is defined as an area of the flowpath 50 where the inflow control device 10 is disposed having a minimum flow area.

The leading edge flow control structure 101A may be cone-shaped with the diameter increasing in the flow direction, and the trailing edge flow control structure 105A may be cone-shaped with the diameter decreasing in the flow direction. The intermediate flow control structure 103A may be a rectangular structure when viewed in the plane of FIG. 1A. The intermediate flow control structure 103A may be a cuboid or cylindrical structure. In other embodiments, other geometric shapes may be employed in the same manner as the foregoing. The leading edge flow control structure 101A and the trailing edge flow control structure 105A may be porous structures. The leading edge flow control structure 101A and the trailing edge flow control structure 105A may be formed as oleophobic, hydrophilic structures. With hydrophilic and oleophobic structures, water tends to stick to the structure more easily allowing more water to pass therethrough, while oil tends to be discouraged from passing therethrough, instead moving around the structure. The intermediate flow control structure 103A may be an oleophobic and hydrophobic structure. The intermediate flow control structure 103A may be a solid, non-porous structure that allows no fluid to pass therethrough. For example, the intermediate flow control structure 103A may be formed of metal, metal oxides, or metal carbides for erosion resistance.

Figure 1B:
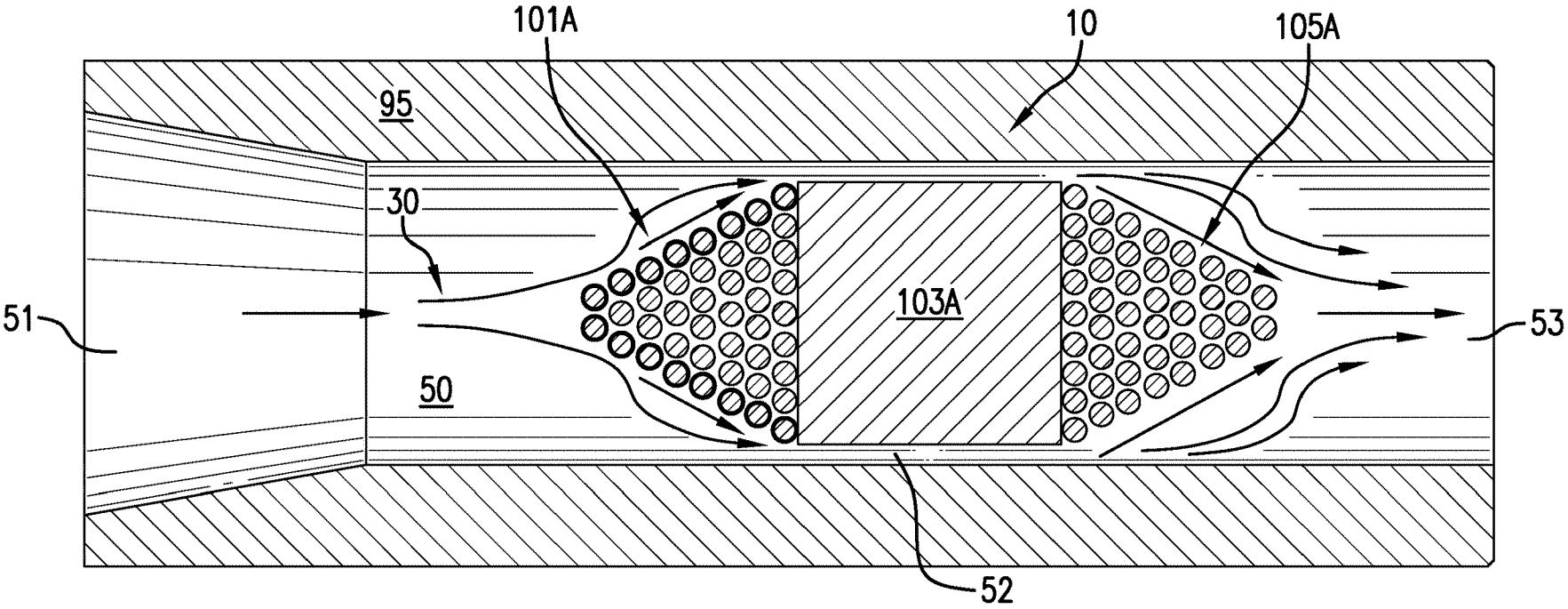
FIG. 1B is a schematic view of the inflow control device of FIG. 1A showing a flow of oil therethrough.

FIG. 1B shows oil 30 passing through the inflow control device 10. As the leading edge flow control structure 10A is oleophobic, the leading edge flow control structure 10A discourages oil 30 from passing therethrough such that, as shown in FIG. 1B, the oil 30 glides over the upstream surface of the leading edge flow control structure 101A to flow around the leading edge flow control structure 101A. Thereafter, the oil 30 passes through the throat 52 of the flowpath 50 around the intermediate flow control structure 103A and flows towards the trailing edge flow control structure 105A. As the trailing edge flow control structure 105A is oleophobic, the trailing edge flow control structure 105A discourages oil 30 from passing through such that, as shown in FIG. 1B, the oil 30 glides over the downstream surface of the trailing edge flow control structure 105A and flows around the trailing edge flow control structure 105A. Thus, the inflow control device 10 is structured such that the oil 30 flows past the inflow control device 10 as substantially idealized flow, with pressure recovery on the back side of the inflow control device with minimal drag.

Figure 1C:
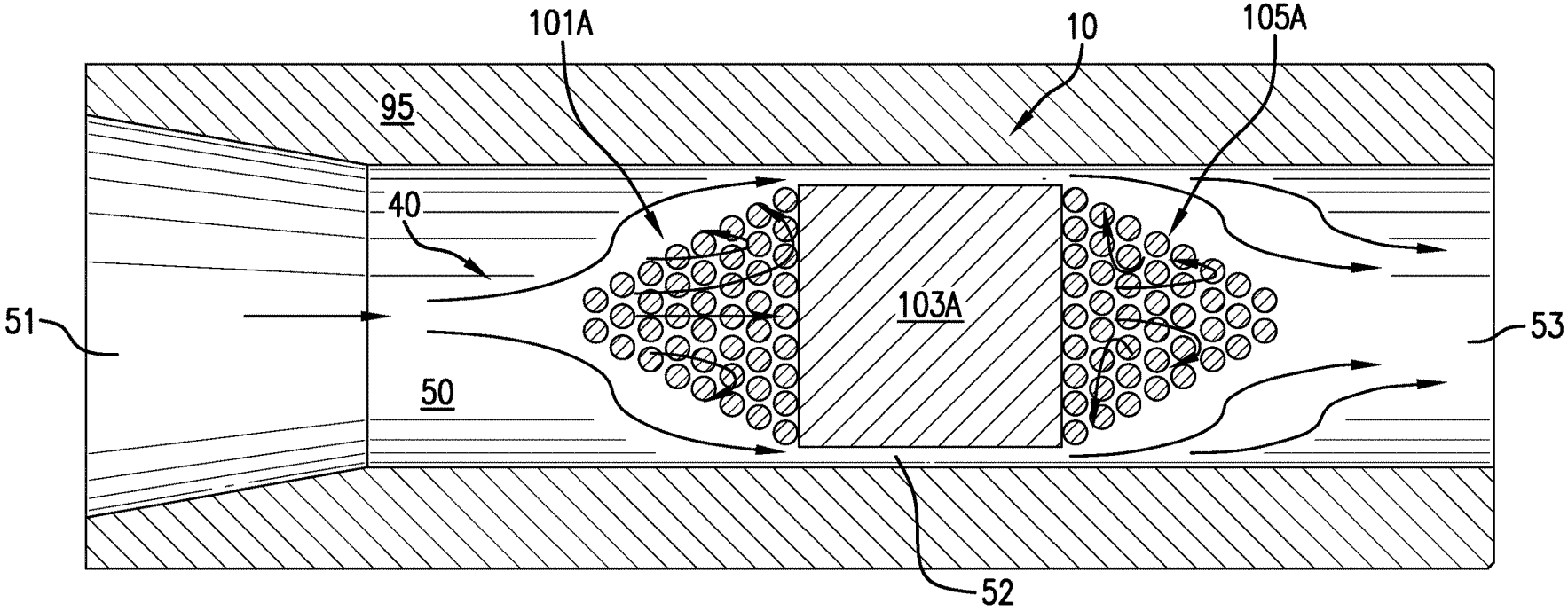
FIG. 1C is a schematic view of the inflow control device of FIG. 1A showing a flow of water therethrough.

FIG. 1C shows water 40 passing through the inflow control device 10. As the leading edge flow control structure 10A is hydrophilic, a portion of the water 40 passes through the leading edge flow control structure 101A and impinges on an upstream surface of the intermediate flow control structure 103A creating some backflow. This may induce turbulence in the flow of water 40 and may also increase water droplet collisions which may induce instability in water streamlines and emulsion. Furthermore, the water-wet surfaces of the leading edge flow control structure 101A as well as the turbulent flow therein may further discourage oil 30 from entering the leading edge flow control structure 101A, improving its oleophobic properties. The water 40 that reaches the throat 52 of the flowpath 50 around the intermediate flow control structure 103A flows towards the trailing edge flow control structure 105A. As the trailing edge flow control structure 105A is hydrophilic, some of the water 40 flowing from the throat 52 may enter the trailing edge flow control structure 105A, as shown in FIG. 1C. This may result in flow separation of the water 40 aft of the throat 52, which may in turn produce turbulent wakes, drag, and pressure drop.

Accordingly, referring to FIGS. IA-1C, oil 30 may see the inflow control device 10 as a streamlined obstruction, while water 40 sees the inflow control device 10 as a bluff body obstruction. As such, the inflow control device 10 discourages higher water percentage fluids while allowing lower water percentage fluids to flow more freely. Thus, flow of fluid with high water concentration tends to flow slower than fluid with low water concentration.

Figure 2A:
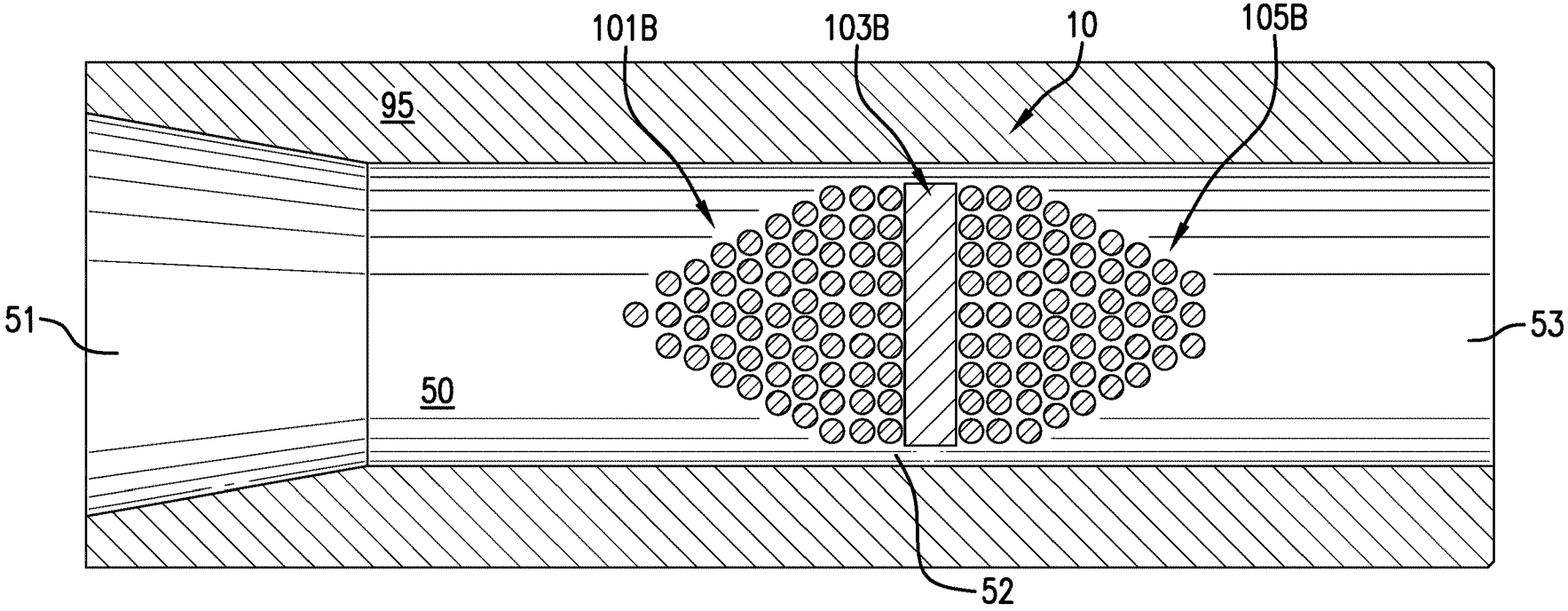
FIG. 2A is a schematic view of an inflow control device according to an embodiment.

Referring to FIG. 2A, an inflow control device 10 according to an embodiment is illustrated. The inflow control device 10 includes a leading edge flow control structure 101B, an intermediate flow control structure 103B, and a trailing edge flow control structure 105B. The leading edge flow control structure 101B and a trailing edge flow control structure 105B are similar to the leading edge flow control structure 101A and a trailing edge flow control structure 105A shown in FIGS. 1A-1C and, thus, a detailed explanation of the structure and function thereof will not be repeated. The inflow control device 10 shown in FIG. 2A differs from that shown in FIG. 1A in that the intermediate flow control structure 103B is plate shaped. The intermediate flow control structure 103B may be an oleophobic and hydrophobic structure. The intermediate flow control structure 103B may be a solid, non-porous structure that allows no fluid to pass therethrough. For example, the intermediate flow control structure 103B may be formed of metal, metal oxides, or metal carbides for erosion resistance.

Figure 2B:
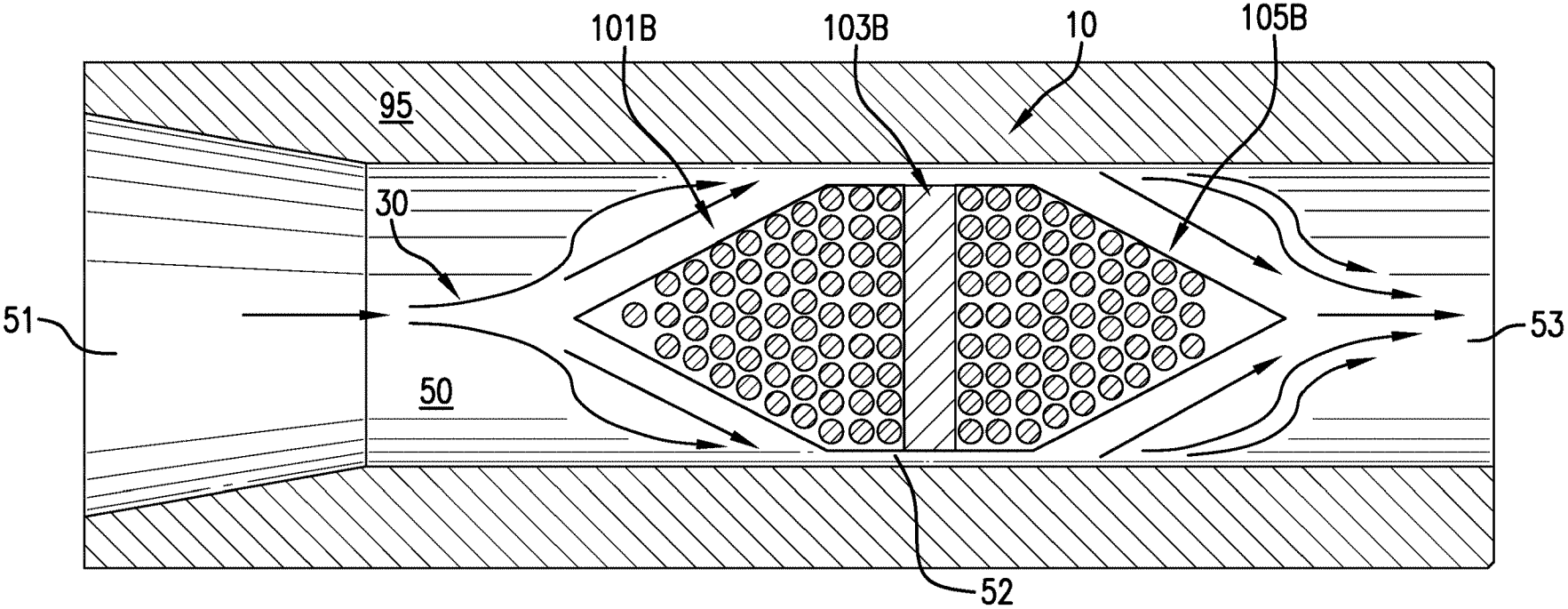
FIG. 2B is a schematic view of the inflow control device of FIG. 2A showing a flow of oil therethrough.

FIG. 2B shows oil 30 passing through the inflow control device 10. As shown, oil 30 flows around the leading edge flow control structure 101B and passes through the throat 52 of the flowpath 50 around the intermediate flow control structure 103B and flows towards the trailing edge flow control structure 105B, then flows around the trailing edge flow control structure 105B. Thus, the inflow control device 10 is structured such that the oil 30 flows past the inflow control device 10 as substantially idealized flow, with pressure recovery on the back side of the inflow control device with minimal drag.

Figure 2C:
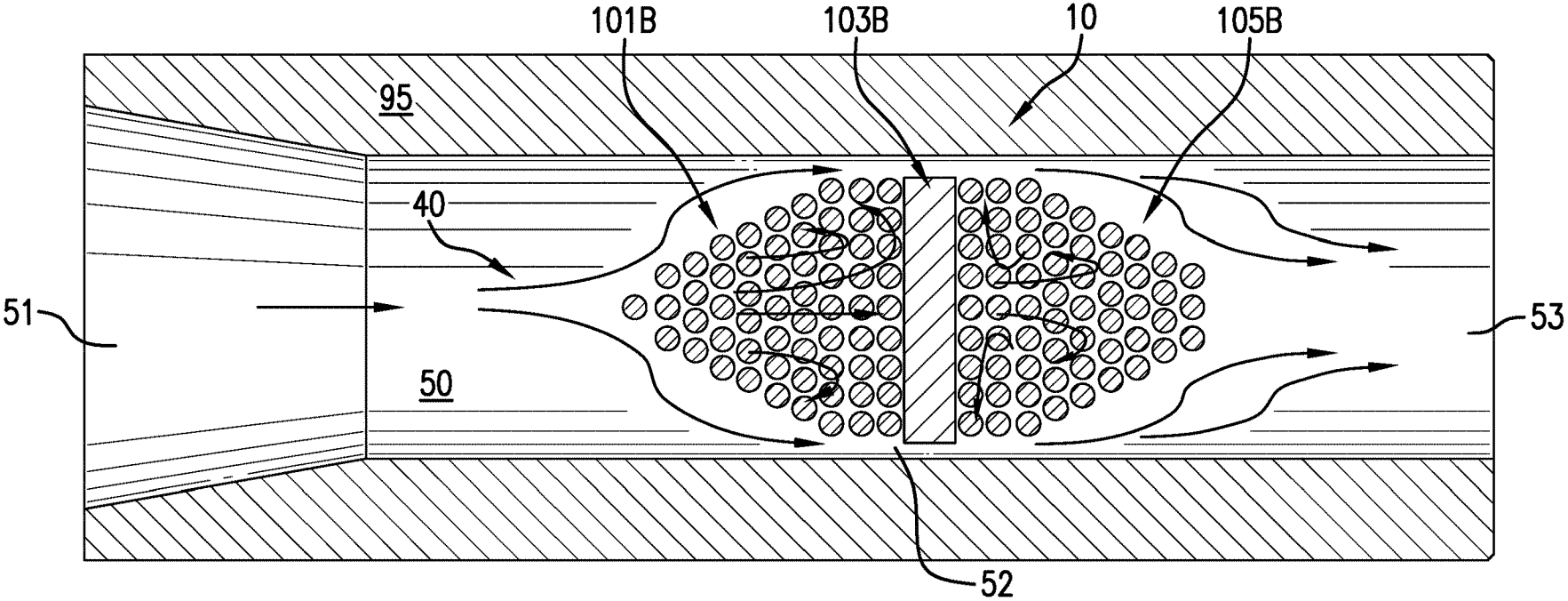
FIG. 2C is a schematic view of the inflow control device of FIG. 2A showing a flow of water therethrough.

FIG. 2C shows water 40 passing through the inflow control device 10. As shown, a portion of the water 40 passes through the leading edge flow control structure 101B and impinges on an upstream surface of the intermediate flow control structure 103B creating some backflow. This may induce turbulence in the flow of water 40 and may also increase water droplet collisions which may induce instability in water streamlines and emulsion. The water 40 that reaches the throat 52 of the flowpath 50 around the intermediate flow control structure 103B flows towards the trailing edge flow control structure 105B. Some of the water 40 flowing from the throat 52 may enter the trailing edge flow control structure 105B, which may result in flow separation of the water 40 aft of the throat 52, which may in turn produce turbulent wakes, drag, and pressure drop.

Accordingly, referring to FIGS. 2A-2C, oil 30 may see the inflow control device 10 as a streamlined obstruction, while water 40 sees the inflow control device 10 as a flat plate obstruction. As such, the inflow control device 10 discourages higher water percentage fluids while allowing lower water percentage fluids to flow more freely. Thus, flow of fluid with high water concentration tends to flow slower than fluid with low water concentration.

Figure 3A:
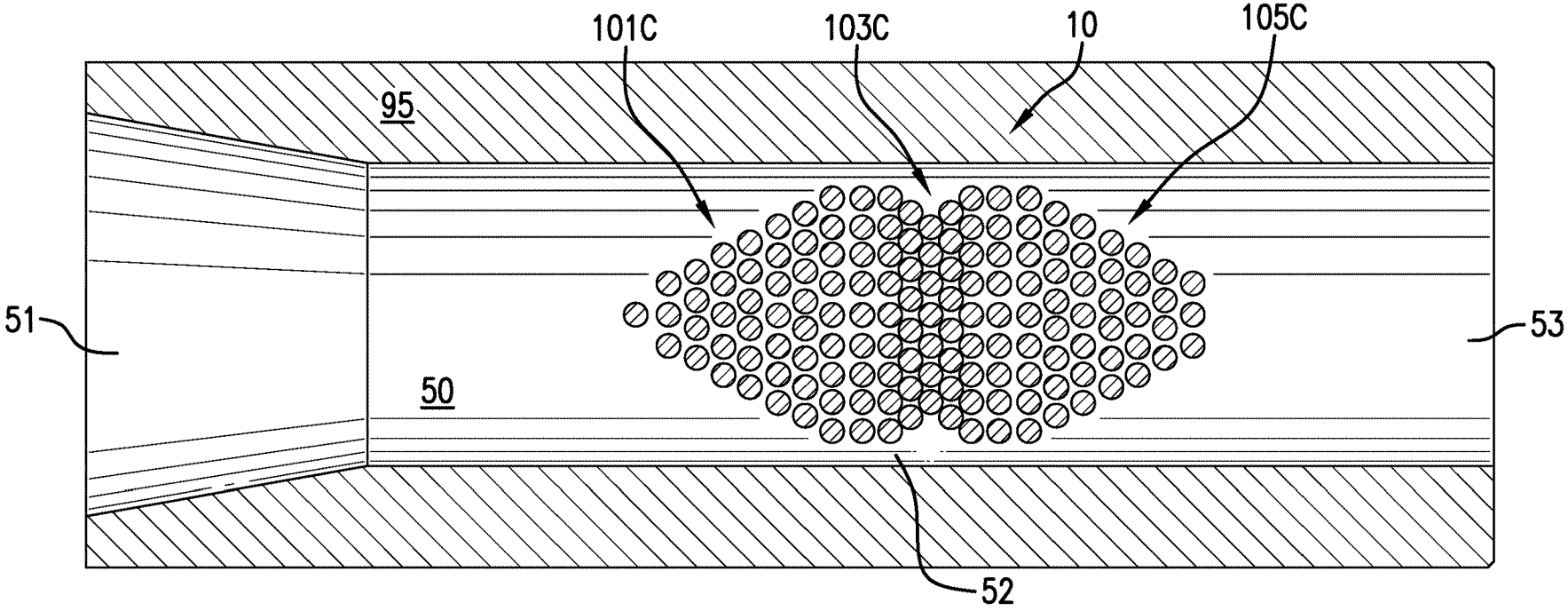
FIG. 3A is a schematic view of an inflow control device according to an embodiment.

Referring to FIG. 3A, an inflow control device 10 according to an embodiment is illustrated. The inflow control device 10 includes a leading edge flow control structure 101C, an intermediate flow control structure 103C, and a trailing edge flow control structure 105C. The leading edge flow control structure 101C and a trailing edge flow control structure 105C are similar to the leading edge flow control structure 101A and a trailing edge flow control structure 105A shown in FIGS. 1A-1C and, thus, a detailed explanation of the structure and function thereof will not be repeated. The inflow control device 10 shown in FIG. 3A differs from that shown in FIG. 1A in that the intermediate flow control structure 103C is formed of similar material as the leading edge flow control structure 101C and the trailing edge flow control structure 105C but is more tightly packed so as to be both oleophobic and hydrophobic. The intermediate flow control structure 103C may be packed to a degree so as to be non-porous allowing no fluid to pass therethrough.

Figure 3B:
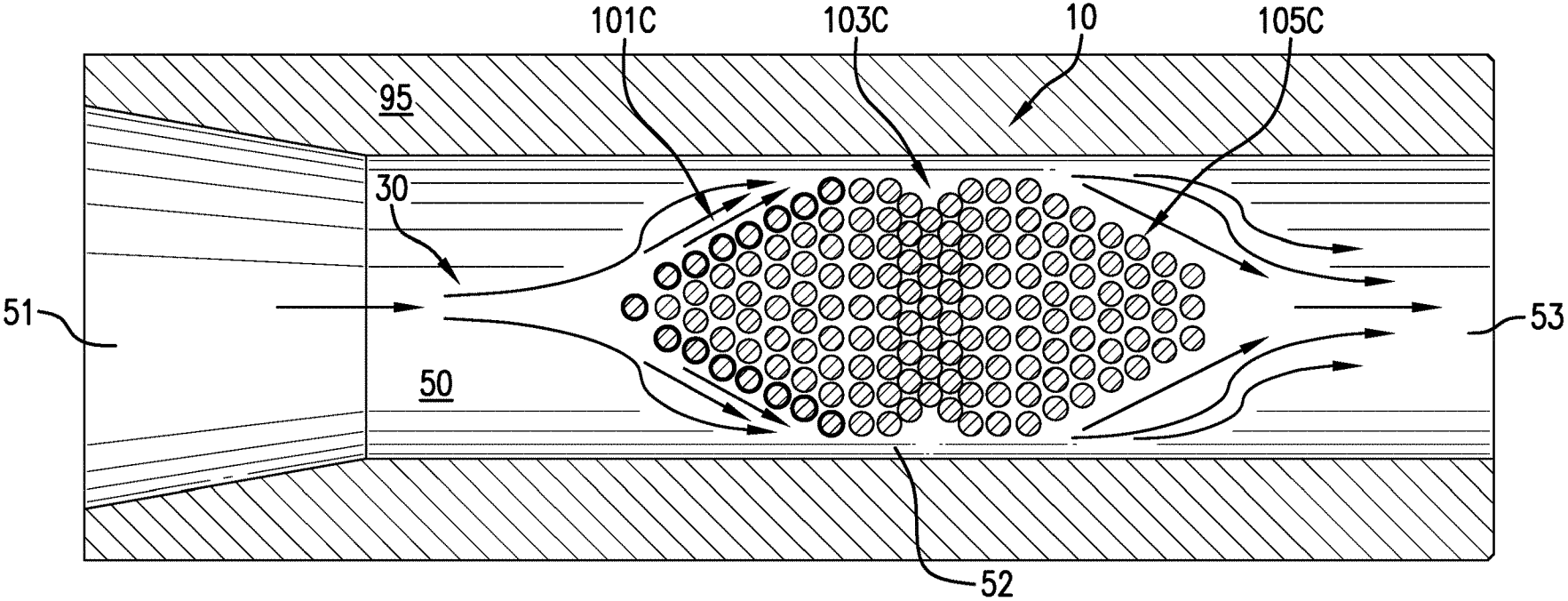
FIG. 3B is a schematic view of the inflow control device of FIG. 3A showing a flow of oil therethrough.

FIG. 3B shows oil 30 passing through the inflow control device 10. As shown, oil 30 flows around the leading edge flow control structure 101C and passes through the throat 52 of the flowpath 50 around the intermediate flow control structure 103C and flows towards the trailing edge flow control structure 105C, then flows around the trailing edge flow control structure 105C. Thus, the inflow control device 10 is structured such that the oil 30 flows past the inflow control device 10 as substantially idealized flow, with pressure recovery on the back side of the inflow control device with minimal drag.

Figure 3C:
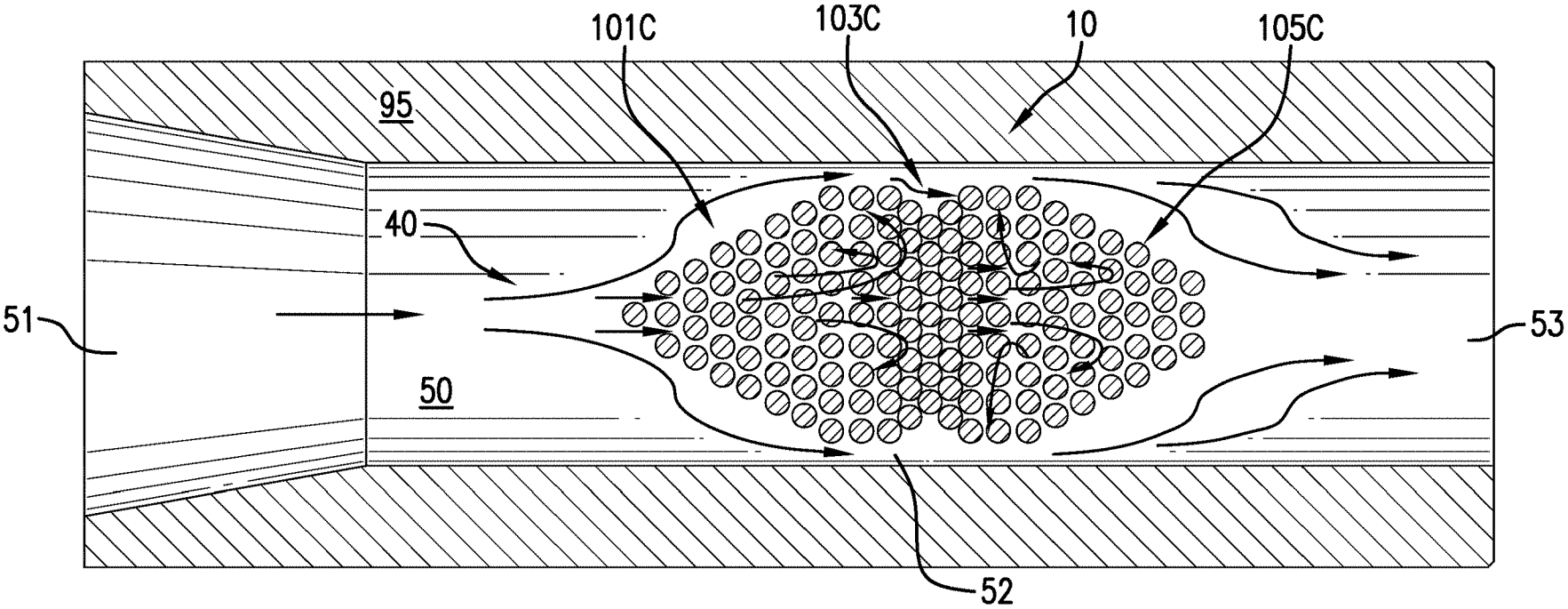
FIG. 3C is a schematic view of the inflow control device of FIG. 3A showing a flow of water therethrough.

FIG. 3C shows water 40 passing through the inflow control device 10. As shown, a portion of the water 40 passes through the leading edge flow control structure 101C and impinges on an upstream surface of the intermediate flow control structure 103C creating some backflow. This may induce turbulence in the flow of water 40 and may also increase water droplet collisions which may induce instability in water streamlines and emulsion. The water 40 that reaches the throat 52 of the flowpath 50 around the intermediate flow control structure 103C flows towards the trailing edge flow control structure 105C. Some of the water 40 flowing from the throat 52 may enter the trailing edge flow control structure 105C, which may result in flow separation of the water 40 aft of the throat 52, which may in turn produce turbulent wakes, drag, and pressure drop.

Accordingly, referring to FIGS. 3A-3C, oil 30 may see the inflow control device 10 as a streamlined obstruction, while water 40 sees the inflow control device 10 as a structure having constriction at the tightly packed intermediate flow control structure 103C. As such, the inflow control device 10 discourages higher water percentage fluids while allowing lower water percentage fluids to flow more freely. Thus, flow of fluid with high water concentration tends to flow slower than fluid with low water concentration.

Figure 4A:
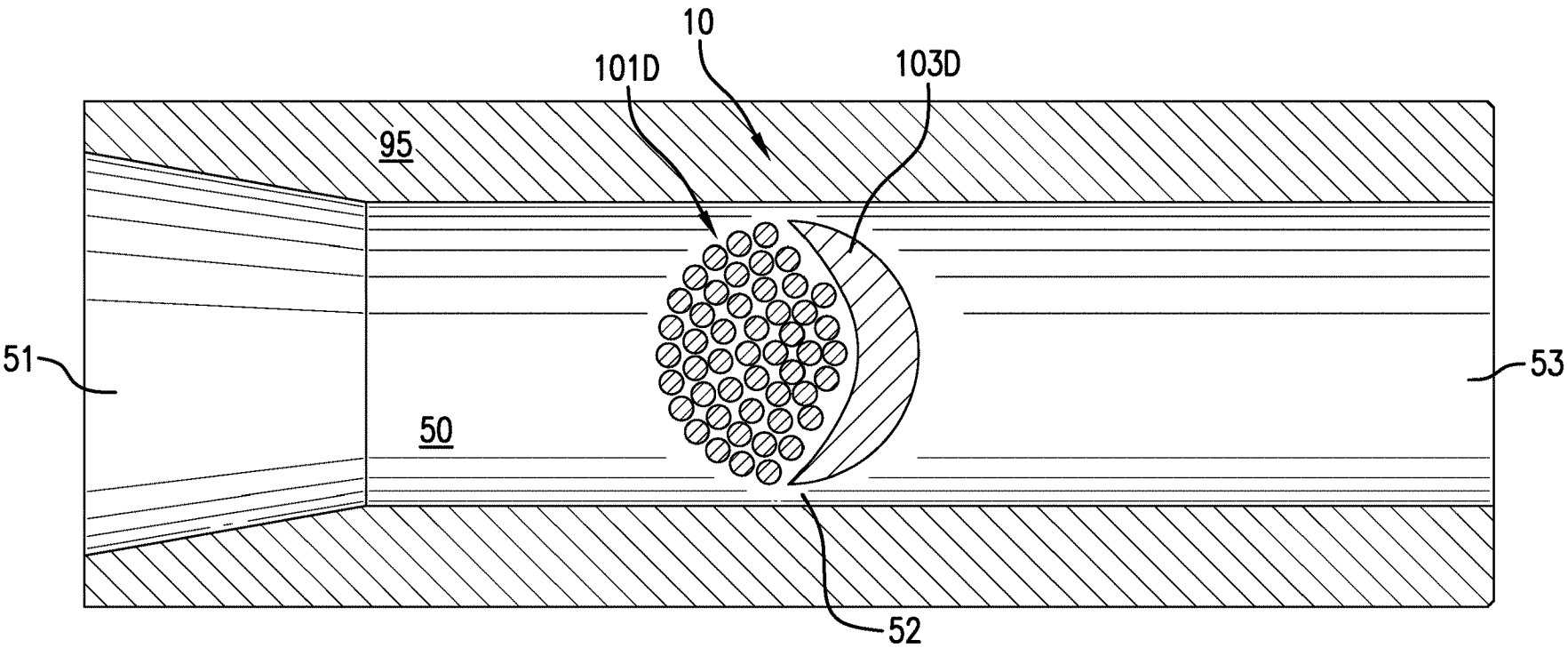
FIG. 4A is a schematic view of an inflow control device according to an embodiment.

Referring to FIG. 4A, an inflow control device 10 according to an embodiment is illustrated. The inflow control device 10 includes a leading edge flow control structure 101D and a downstream flow control structure 103D. A throat 52 of the flowpath 50 is defined between an outer surface of the downstream flow control structure 103D and an inner surface of the housing 95.

In a cross-section perpendicular to the flow direction of the flowpath 50, the leading edge flow control structure 101D may be shaped as a half circle with a convex downstream surface so as to be gibbous-shaped, and the downstream flow control structure 103D may be shaped as a half circle with a concave upstream surface so as to have a crescent-shaped cross-section. As shown in FIG. 4A, the convex surface of the leading edge flow control structure 101D and the concave surface of the downstream flow control structure 103D may be complementary. The leading edge flow control structure 101D may be a porous structure. The leading edge flow control structure 101D may be formed as an oleophobic, hydrophilic structure. The downstream flow control structure 103D may be an oleophobic and hydrophobic structure. The downstream flow control structure 103D may be a solid, non-porous structure that allows no fluid to pass therethrough. For example, the downstream flow control structure 103D may be formed of metal, metal oxides, or metal carbides for erosion resistance.

Figure 4B:
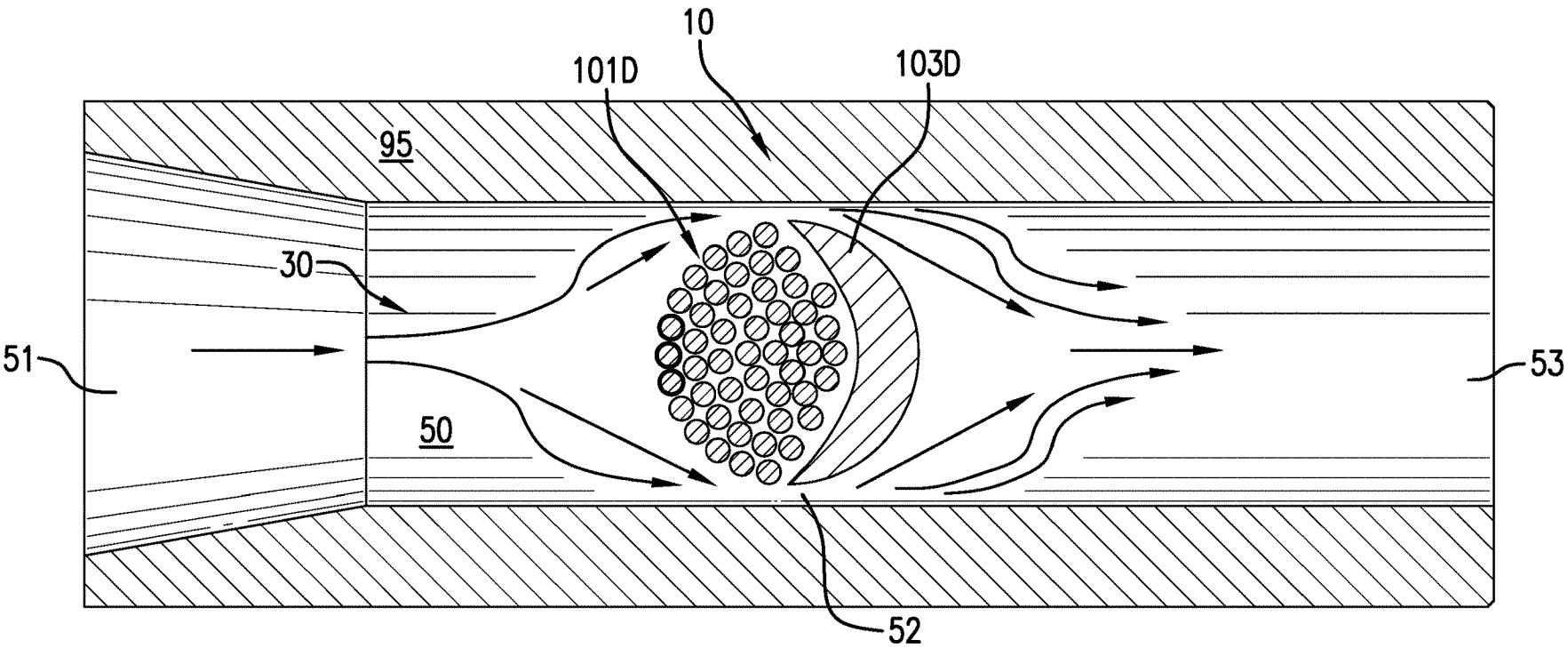
FIG. 4B is a schematic view of the inflow control device of FIG. 4A showing a flow of oil therethrough.

FIG. 4B shows oil 30 passing through the inflow control device 10. As the leading edge flow control structure 101D is oleophobic, the leading edge flow control structure 101D discourages oil 30 from passing therethrough such that, as shown in FIG. 4B, the oil 30 glides over the upstream surface of the leading edge flow control structure 101D to flow around the leading edge flow control structure 101D. Thereafter, the oil 30 passes through the throat 52 of the flowpath 50 around the downstream control structure 103D and towards the outlet 53. Thus, the inflow control device 10 is structured such that the oil 30 flows past the inflow control device 10 as substantially idealized flow, with pressure recovery on the back side of the inflow control device with minimal drag.

Figure 4C:
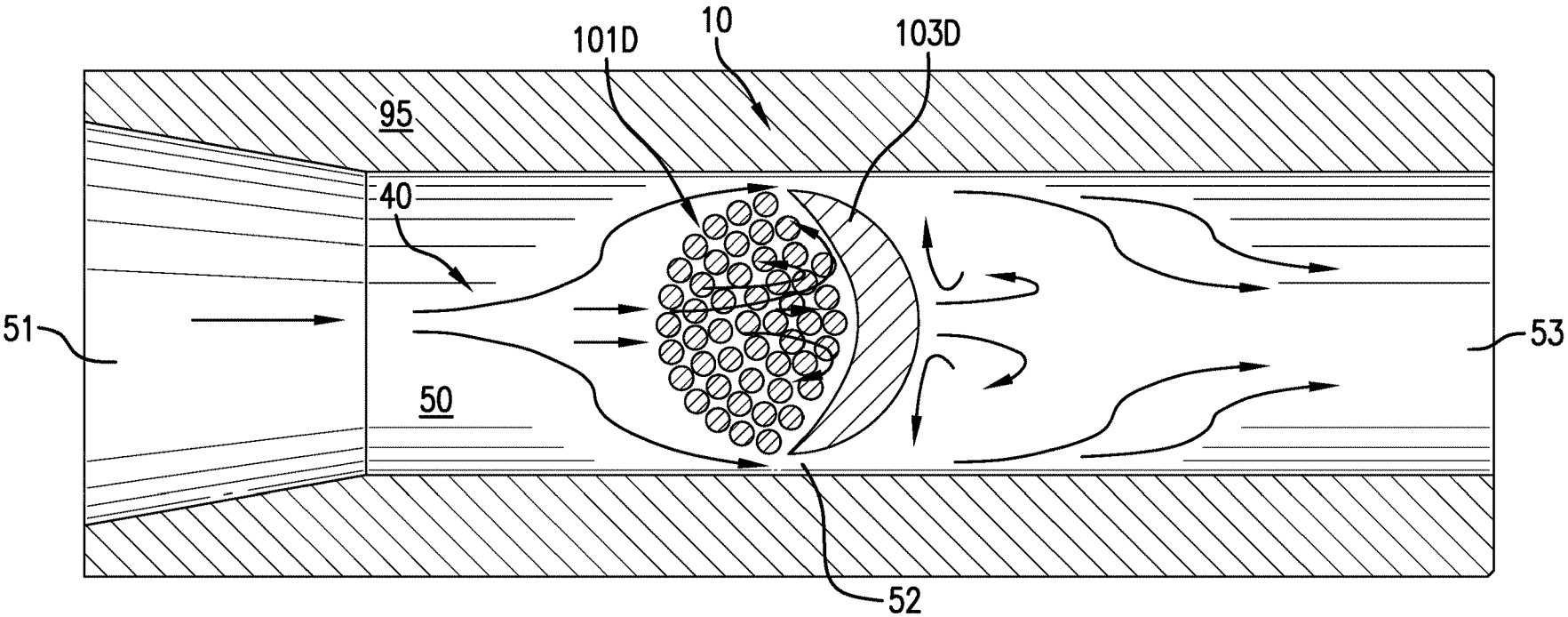
FIG. 4C is a schematic view of the inflow control device of FIG. 4A showing a flow of water therethrough.

FIG. 4C shows water 40 passing through the inflow control device 10. As the leading edge flow control structure 101D is hydrophilic, a portion of the water 40 passes through the leading edge flow control structure 101D and impinges on an upstream surface of the downstream flow control structure 103D creating some backflow. This may induce turbulence in the flow of water 40 and may also increase water droplet collisions which may induce instability in water streamlines and emulsion. Furthermore, the water-wet surfaces of the leading edge flow control structure 101D as well as the turbulent flow therein may further discourage oil 30 from entering the leading edge flow control structure 101D, improving its oleophobic properties. The water 40 that reaches the throat 52 of the flowpath 50 around the downstream flow control structure 103D may be turbulent flow due to the backflow, and some portion thereof may flow towards the downstream surface of the downstream flow control structure 103D, as shown in FIG. 4C. This may result in flow separation of the water 40 aft of the throat 52, which may in turn produce turbulent wakes, drag, and pressure drop.

Accordingly, referring to FIGS. 4A-4C, oil 30 may see the inflow control device 10 as a streamlined obstruction, while water 40 may see the inflow control device 10 as a half circle with a concave surface. As such, the inflow control device 10 discourages higher water percentage fluids while allowing lower water percentage fluids to flow more freely. Thus, flow of fluid with high water concentration tends to flow slower than fluid with low water concentration.

Figure 5A:
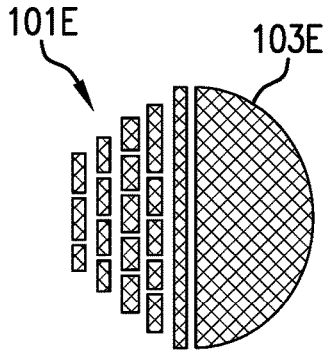
FIG. 5A is a schematic view of an inflow control device according to an embodiment.

Referring to FIG. 5A, an inflow control device 10 according to an embodiment is illustrated. The inflow control device 10 includes a leading edge flow control structure 101E and a downstream flow control structure 103E. While not shown in FIG. 5A, similarly to the embodiment of FIG. 4A, a throat 52 of the flowpath 50 is defined between an outer surface of the downstream flow control structure 103E and an inner surface of the housing 95.

In a cross-section perpendicular to the flow direction of the flowpath 50, the leading edge flow control structure 101E may be shaped as a truncated cone, and the downstream flow control structure 103E may be shaped as a half circle. The leading edge flow control structure 101E may be a porous structure. As shown, the leading edge flow control structure 101E is formed of stacked discs with pores therebetween. Each disc may be formed of metal, metal oxides, or metal carbides. The stacked discs may have, for example, 1 μm pores formed therebetween. The stacked discs may have, for example, pores formed therebetween between 0.8 μm and 1.2 μm. This specific pore size is merely exemplary and not intended to be limiting. The leading edge flow control structure 101E may be formed as an oleophobic, hydrophilic structure. The downstream flow control structure 103E may be an oleophobic and hydrophobic structure. The downstream flow control structure 103E may be a solid, non-porous structure that allows no fluid to pass therethrough. For example, the downstream flow control structure 103E may be formed of metal, metal oxides, or metal carbides for erosion resistance.

Figure 5B:
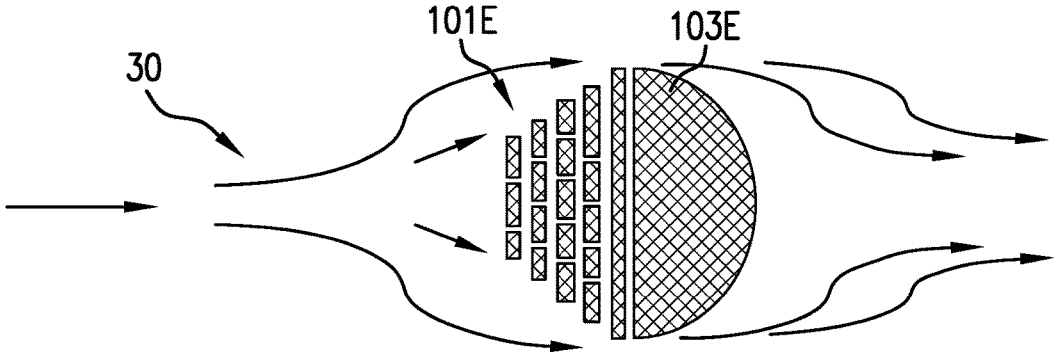
FIG. 5B is a schematic view of the inflow control device of FIG. 5A showing a flow of oil therethrough.

FIG. 5B shows oil 30 passing through the inflow control device 10. As the leading edge flow control structure 101E is oleophobic, the leading edge flow control structure 101E discourages oil 30 from passing therethrough such that, as shown in FIG. 5B, the oil 30 glides over the upstream surface of the leading edge flow control structure 101E to flow around the leading edge flow control structure 101E. Thereafter, the oil 30 passes through the throat 52 of the flowpath 50 around the downstream control structure 103E and towards the outlet. Thus, the inflow control device 10 is structured such that the oil 30 flows past the inflow control device 10 as substantially idealized flow, with pressure recovery on the back side of the inflow control device with minimal drag.

Figure 5C:
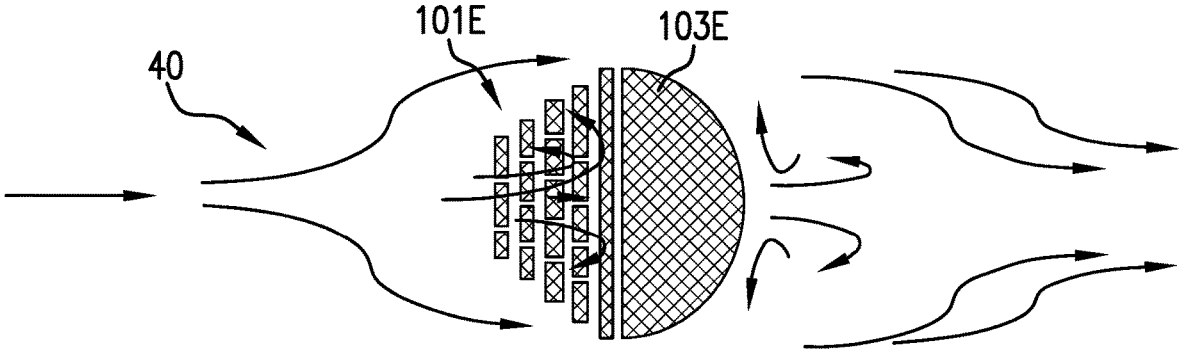
FIG. 5C is a schematic view of the inflow control device of FIG. 5A showing a flow of water therethrough.

FIG. 5C shows water 40 passing through the inflow control device 10. As the leading edge flow control structure 101E is hydrophilic, a portion of the water 40 passes through the leading edge flow control structure 101E and impinges on an upstream surface of the downstream flow control structure 103E creating some backflow. This may induce turbulence in the flow of water 40 and may also increase water droplet collisions which may induce instability in water streamlines and emulsion. Furthermore, the water-wet surfaces of the leading edge flow control structure 101E as well as the turbulent flow therein may further discourage oil 30 from entering the leading edge flow control structure 101E, improving its oleophobic properties. The water 40 that reaches the throat 52 of the flowpath 50 around the downstream flow control structure 103E may be turbulent flow due to the backflow, and some portion thereof may flow towards the downstream surface of the downstream flow control structure 103E, as shown in FIG. 5C. This may result in flow separation of the water 40 aft of the throat 52, which may in turn produce turbulent wakes, drag, and pressure drop.

Accordingly, referring to FIGS. 5A-5C, oil 30 may see the inflow control device 10 as a streamlined obstruction, while water 40 may see the inflow control device 10 as a half circle. As such, the inflow control device 10 discourages higher water percentage fluids while allowing lower water percentage fluids to flow more freely. Thus, flow of fluid with high water concentration tends to flow slower than fluid with low water concentration.

Figure 6A:
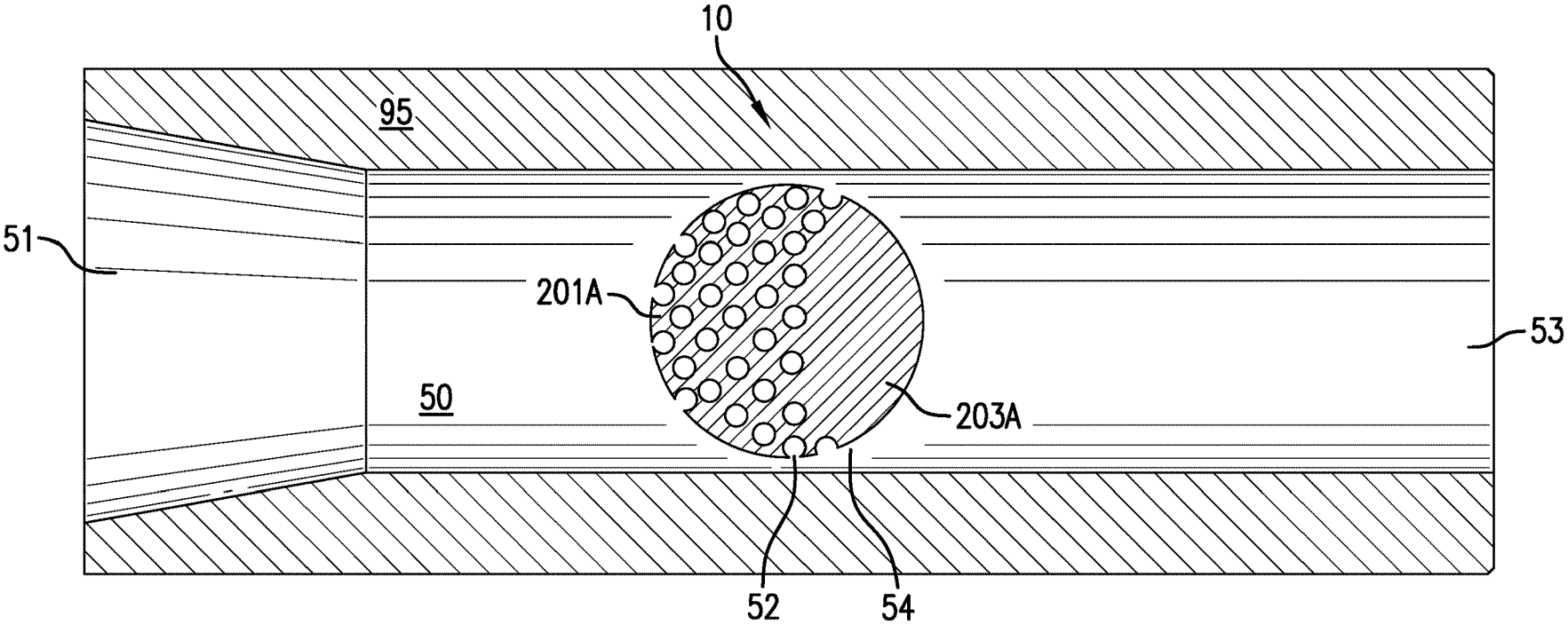
FIG. 6A is a schematic view of an inflow control device according to an embodiment.

Referring to FIG. 6A, an inflow control device 10 according to an embodiment is illustrated. The inflow control device 10 includes a leading edge flow control structure 201A and a downstream flow control structure 203A. A throat 52 of the flowpath 50 is defined between an outer surface of the leading edge flow control structure 201A and an inner surface of the housing 95.

In a cross-section perpendicular to the flow direction of the flowpath 50, the leading edge flow control structure 201A and the downstream flow control structure 203A may be formed integrally as a circle-shaped structure. That is, the leading edge flow control structure 201A and the downstream flow control structure 203A are formed as a unitary structure that is a circle in the cross-section perpendicular to the flow direction of the flowpath 50. The leading edge flow control structure 201A includes pores so as to be a porous structure. The leading edge flow control structure 201A may be formed as a hydrophobic, oleophilic structure. With hydrophobic and oleophilic structures, oil tends to stick to the structure more easily allowing more oil to pass therethrough, while water tends to be discouraged from passing therethrough, instead moving around the structure. The downstream flow control structure 203A may be an oleophobic and hydrophobic structure. The downstream flow control structure 203A may be a solid, non-porous structure that allows no fluid to pass therethrough. For example, the downstream flow control structure 203A may be formed of metal, metal oxides, or metal carbides, and the leading edge flow control structure 201A may be formed of metal, metal oxides, or metal carbides with pores formed therein. The downstream flow control structure 203A may extend past the position of the throat 52 of the flowpath 50. The leading edge flow control structure 201A may include a plurality of pores that, near an outer surface of the circle, extends further downstream than a center of the circle.

Figure 6B:
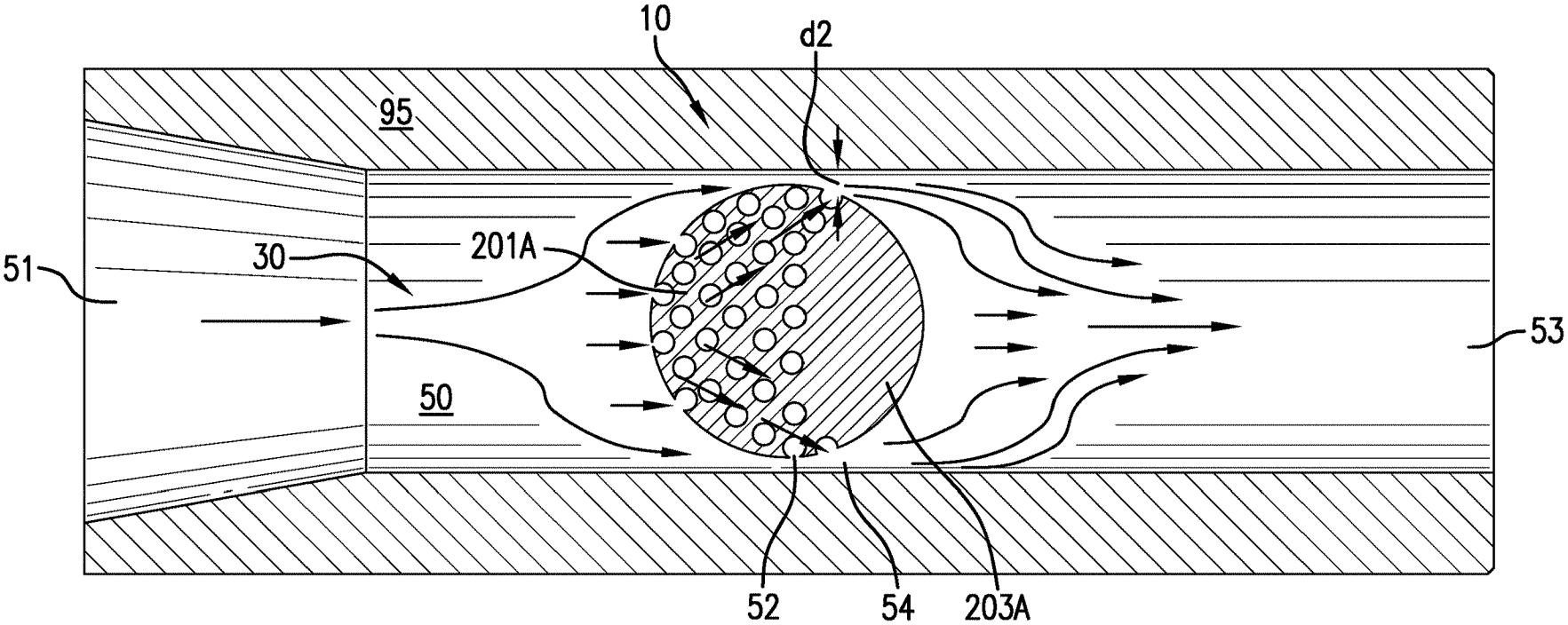
FIG. 6B is a schematic view of the inflow control device of FIG. 6A showing a flow of oil therethrough.

FIG. 6B shows oil 30 passing through the inflow control device 10. As the leading edge flow control structure 201A is oleophilic, the leading edge flow control structure 201A allows oil 30 to pass therethrough such that, as shown in FIG. 6B, at least a portion of the oil 30 flows within the leading edge flow control structure 201A to an area downstream of the throat 52. Thereafter, the oil 30 flows towards the outlet 53 of the flowpath 50. Because the oil 30 passing through the leading edge flow control structure 201A bypasses the throat 52, the flow is restricted less than if the entire flow of oil 30 were required to pass through the throat 52. For example, the narrowest portion of the flowpath 50 that the oil 30 experiences is a distance d2 between the upstream-most outer surface of the downstream flow control structure 203A and the inner surface of the housing 95. This distance d2 is greater than the distance d1 between an outer surface of the leading edge flow control structure 201A and an inner surface of the housing 95 at the throat 52 (see FIG. 6C). For example, the distance d1 at the throat may be 2.0 mm, while the minimum distance d2 through which the oil 52 passes may be 3.5 mm. These distances are merely exemplary and not intended to be limiting. Thus, the inflow control device 10 is structured such that the oil 30 bypasses the constriction at the throat 52, and the streamline of the flow of oil 30 sticks together longer and trips later downstream than if the oil 30 had to pass entirely through the throat 52.

Figure 6C:
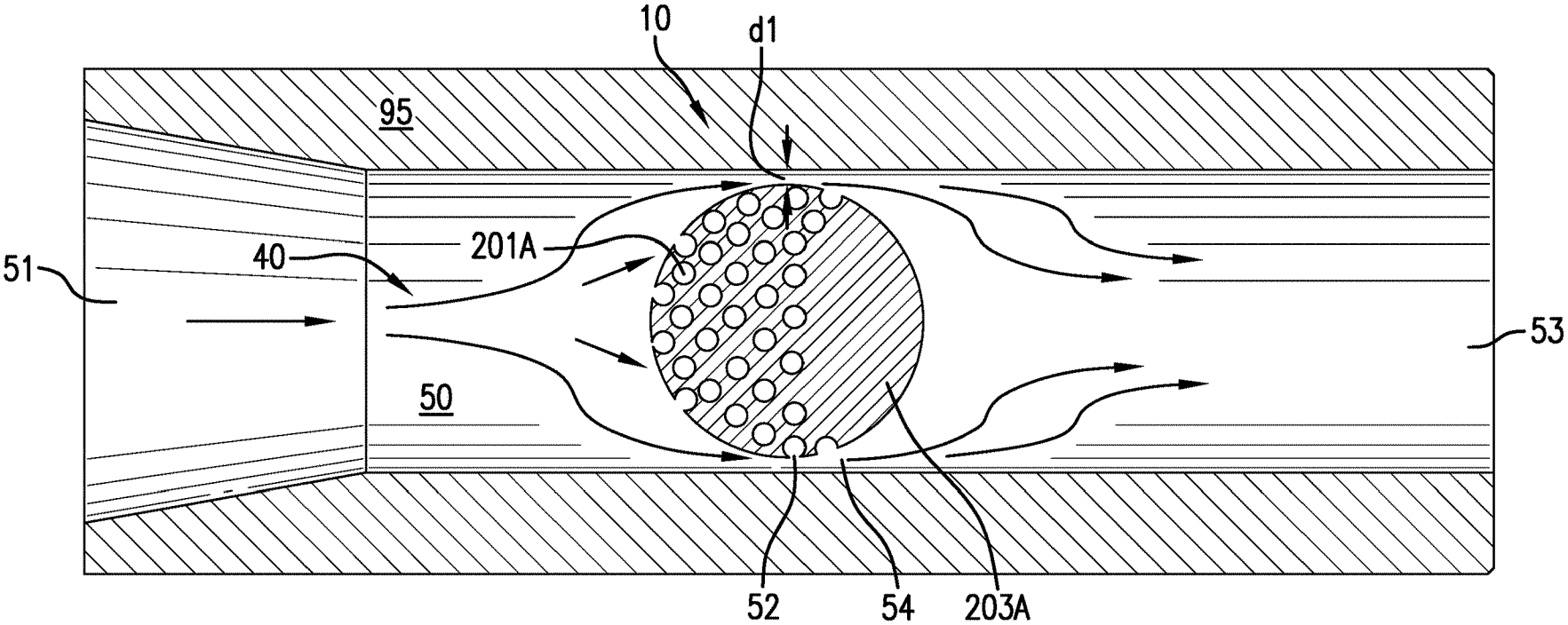
FIG. 6C is a schematic view of the inflow control device of FIG. 6A showing a flow of water therethrough.

FIG. 6C shows water 40 passing through the inflow control device 10. As the leading edge flow control structure 201A is hydrophobic, the water 40 is discouraged from entering the leading edge flow control structure 201A and passes mostly or entirely through the constriction at the throat 52, which results in the flow of the water 40 separating sooner and the drag being larger than for the oil 30 that bypasses the constriction at the throat 52. According to one or more embodiments, the distance d1 between the outer surface of the leading edge flow control structure 201A and the inner surface of the housing 95 at the throat 52 may be set so that the water laminar-turbulent transition is altered.

Accordingly, referring to FIGS. 6A-6C, the minimum flow area through which the oil 30 passes is larger than the minimum flow area through which the water 40 passes, the separation point of the oil 40 is further downstream than the water 30, creating a less turbulent flow for oil 40 than water 30. As such, the inflow control device 10 discourages higher water percentage fluids while allowing lower water percentage fluids to flow more freely. Thus, flow of fluid with high water concentration tends to flow slower than fluid with low water concentration.

Figure 7A:
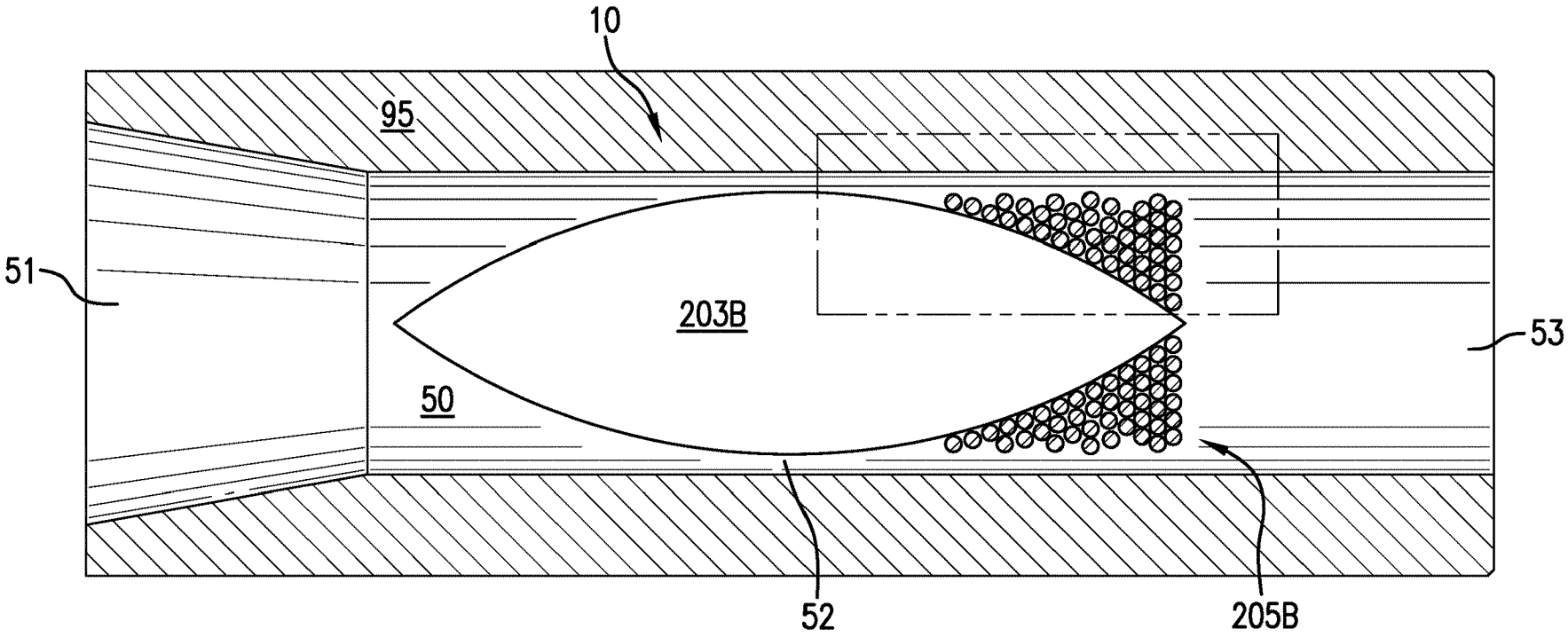
FIG. 7A is a schematic view of an inflow control device according to an embodiment.

Referring to FIG. 7A, an inflow control device 10 according to an embodiment is illustrated. The inflow control device 10 includes an upstream flow control structure 203B and a trailing edge flow control structure 205B. A throat 52 of the flowpath 50 is defined between an outer surface of the upstream flow control structure 203B and an inner surface of the housing 95. According to one or more embodiments, the throat 52 is defined as an area of the flowpath 50 where the inflow control device 10 is disposed having a minimum flow area.

In a cross-section perpendicular to the flow direction of the flowpath 50, the upstream flow control structure 203B may be an almond-shaped structure. The trailing edge flow control structure 205B is disposed downstream of the throat 52 and may have an inner surface that follows the contour of an outer surface of the upstream flow control structure 203B, and an outer surface that is substantially constant in diameter. The upstream flow control structure 203B may be an oleophobic and hydrophobic structure. The upstream flow control structure 203B may be a solid, non-porous structure that allows no fluid to pass therethrough. For example, the upstream flow control structure 203B may be formed of metal, metal oxides, or metal carbides. The trailing edge flow control structure 205B may be a porous structure. The trailing edge flow control structure 205B may be formed as oleophilic, hydrophobic structures.

Figure 7B:
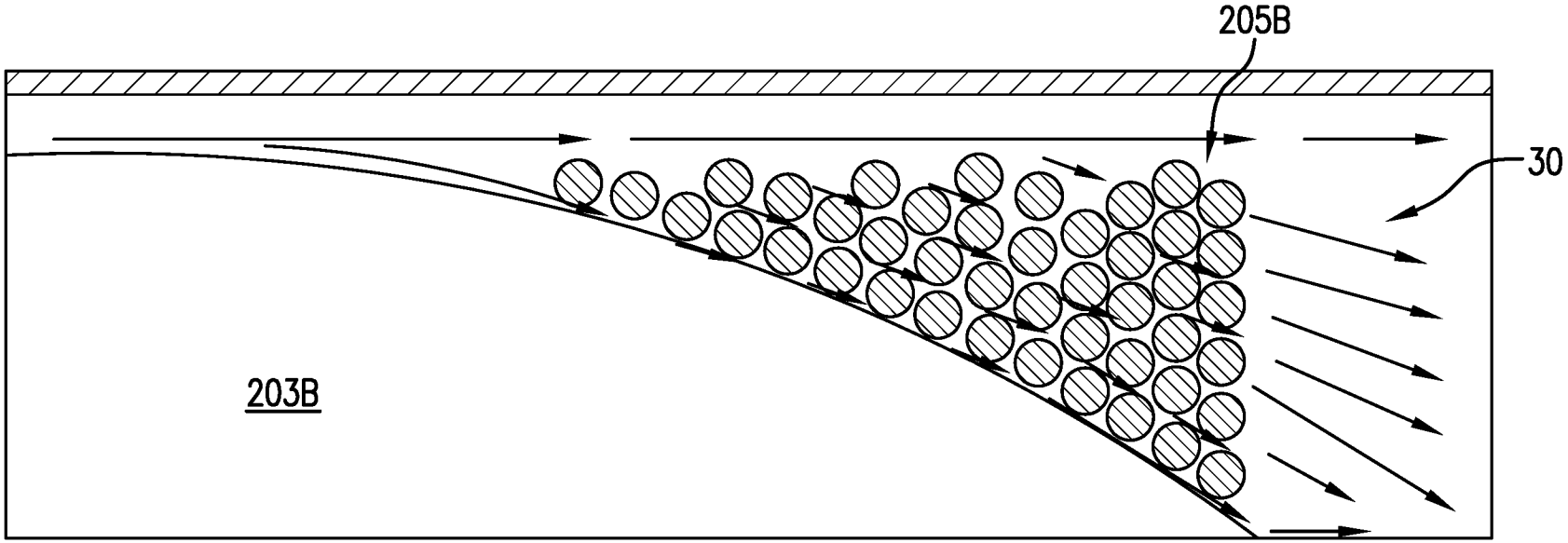
FIG. 7B is a partial schematic view of the inflow control device of FIG. 7A showing a flow of oil therethrough.

FIG. 7B shows oil 30 passing through an upper portion the inflow control device 10 downstream of the throat 52. After passing through the throat 52, the oil 30 flows towards the trailing edge flow control structure 205B. Because the trailing edge flow control structure 205B is oleophilic, the trailing edge flow control structure 205B allows some of the oil 30 to pass therethrough. As such, the flow of oil 30 generally follows the almond-shaped upstream flow control structure 203B, which is a shape that promotes a streamlined and idealized flow.

Figure 7C:
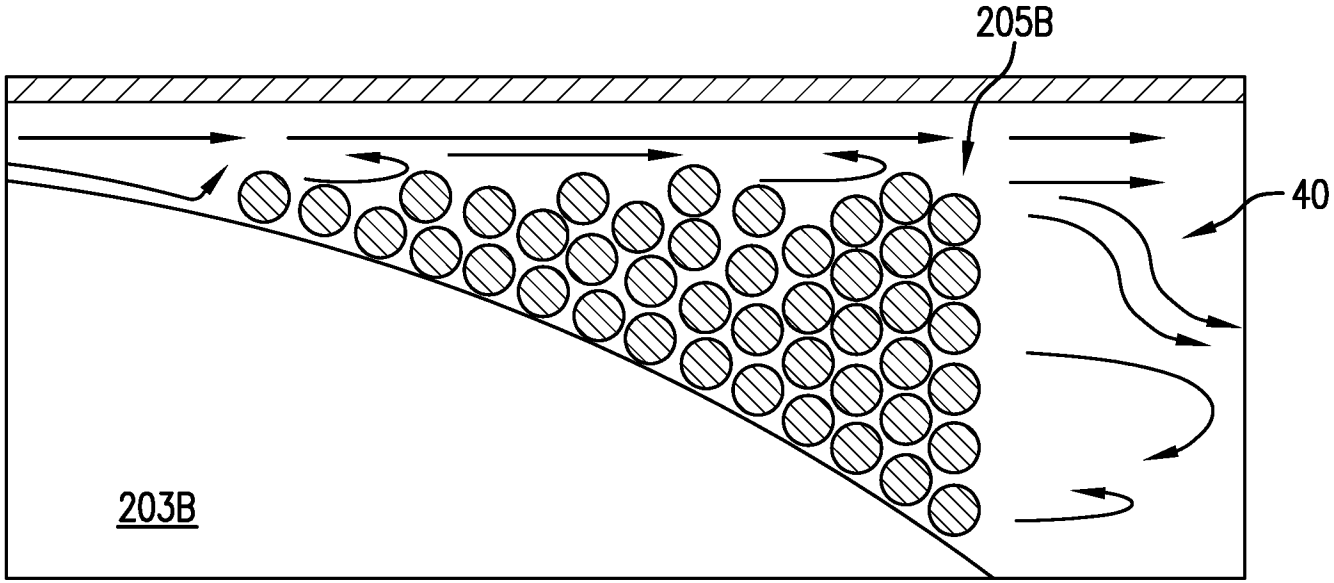
FIG. 7C is a partial schematic view of the inflow control device of FIG. 7A showing a flow of water therethrough.

FIG. 7C shows water 40 passing through the inflow control device 10. After passing through the throat 52, the oil 30 flows towards the trailing edge flow control structure 205B. Because the trailing edge flow control structure 205B is hydrophobic, the trailing edge flow control structure 205B discourages water 40 from passing therethrough. Thus, the water 40 drags across the outer surface of the trailing edge flow control structure 205B to the flat downstream surface of the trailing edge flow control structure 205B, as shown in FIG. 7C. In addition to the trailing edge flow control structure 205B, opposing oil films may constrict the flow of water 40 as well, increasing droplet collisions and pressure. This may result in flow separation of the water 40 aft of the throat 52, which may in turn produce turbulent wakes, drag, and pressure drop.

Accordingly, referring to FIGS. 7A-7C, oil 30 may see the inflow control device 10 as a streamlined obstruction, while water 40 sees the inflow control device 10 as a bluff body obstruction. As such, the inflow control device 10 discourages higher water percentage fluids while allowing lower water percentage fluids to flow more freely. Thus, flow of fluid with high water concentration tends to flow slower than fluid with low water concentration.

Figure 8A:
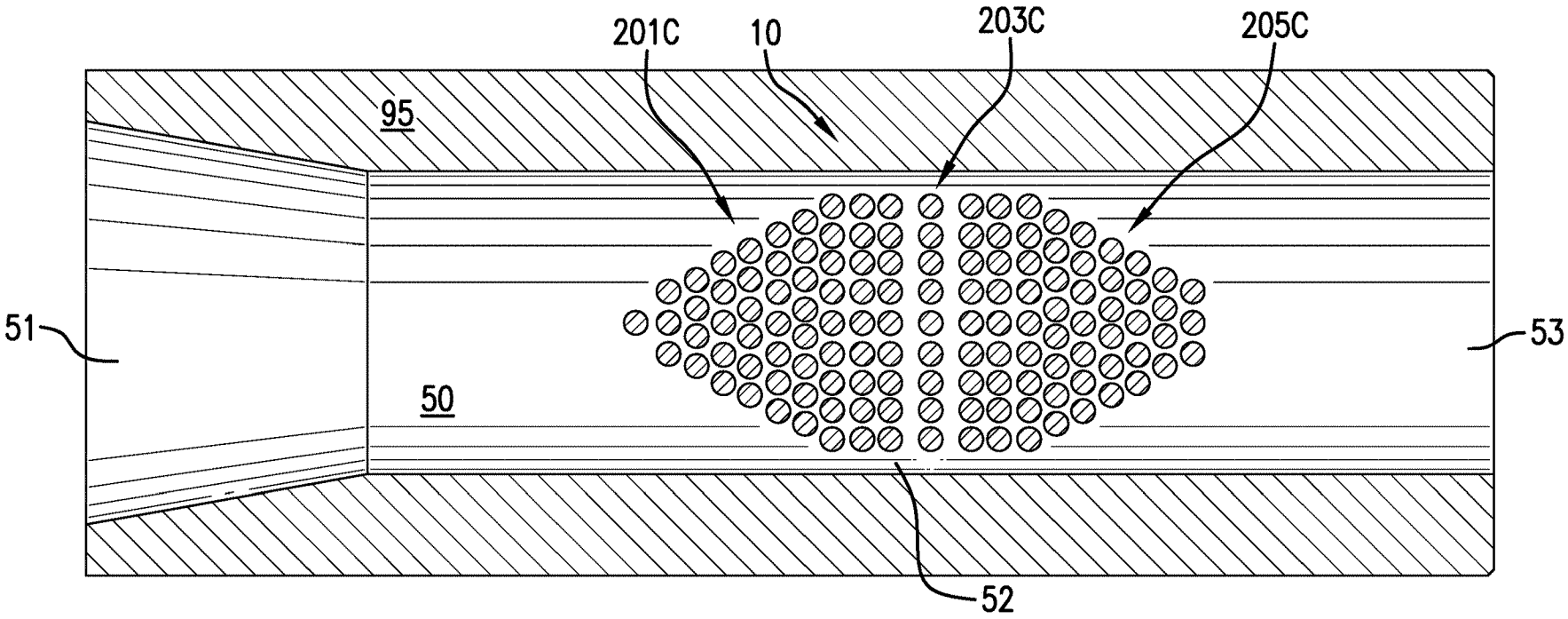
FIG. 8A is a schematic view of an inflow control device according to an embodiment.

Referring to FIG. 8A, an inflow control device 10 according to an embodiment is illustrated. The inflow control device 10 includes a leading edge flow control structure 201C, an intermediate flow control structure 203C, and a trailing edge flow control structure 205C. A throat 52 of the flowpath 50 is defined between an outer surface of the intermediate flow control structure 203C and an inner surface of the housing 95. According to one or more embodiments, the throat 52 is defined as an area of the flowpath 50 where the inflow control device 10 is disposed having a minimum flow area.

The leading edge flow control structure 201C may be cone-shaped with the diameter increasing in the flow direction, and the trailing edge flow control structure 205C may be cone-shaped with the diameter decreasing in the flow direction. The intermediate flow control structure 203C may be a plate-shaped structure. The leading edge flow control structure 201C, the intermediate flow control structure 203C, and the trailing edge flow control structure 205C may be porous structures. The leading edge flow control structure 201C, the intermediate flow control structure 203C, and the trailing edge flow control structure 205C may be formed as oleophilic structures. The leading edge flow control structure 201C may be formed as a hydrophobic structure. The intermediate flow control structure 203C and the trailing edge flow control structure 205C may be hydrophobic structures as well.

Figure 8B:
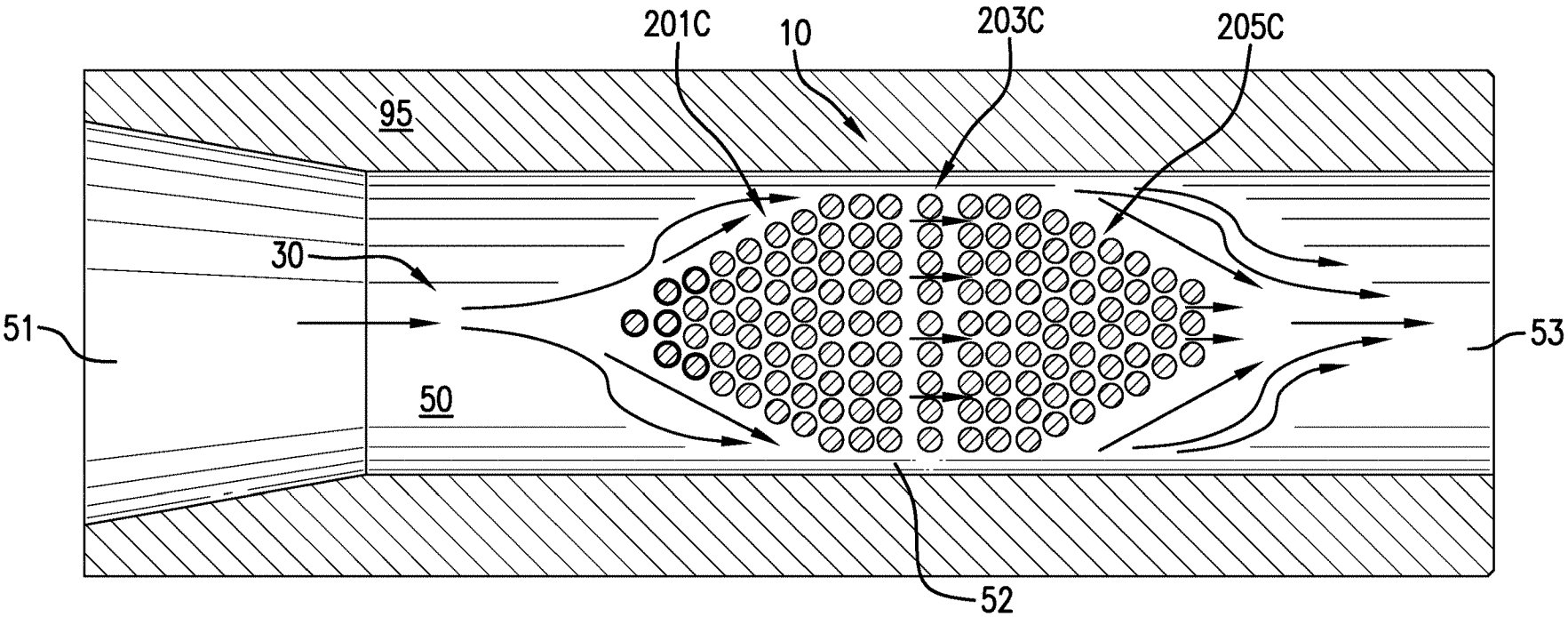
FIG. 8B is a schematic view of the inflow control device of FIG. 8A showing a flow of oil therethrough.

FIG. 8B shows oil 30 passing through the inflow control device 10. As the leading edge flow control structure 201C, the intermediate flow control structure 203C, and the trailing edge flow control structure 205C are oleophilic, some portion of oil 30 passes through the leading edge flow control structure 201C, the intermediate flow control structure 203C, and the trailing edge flow control structure 205C while the remainder passes around the inflow control device 10 such that, as shown in FIG. 8B, the oil 30 is organized and diffused while flowing through the inflow control device 10.

Figure 8C:
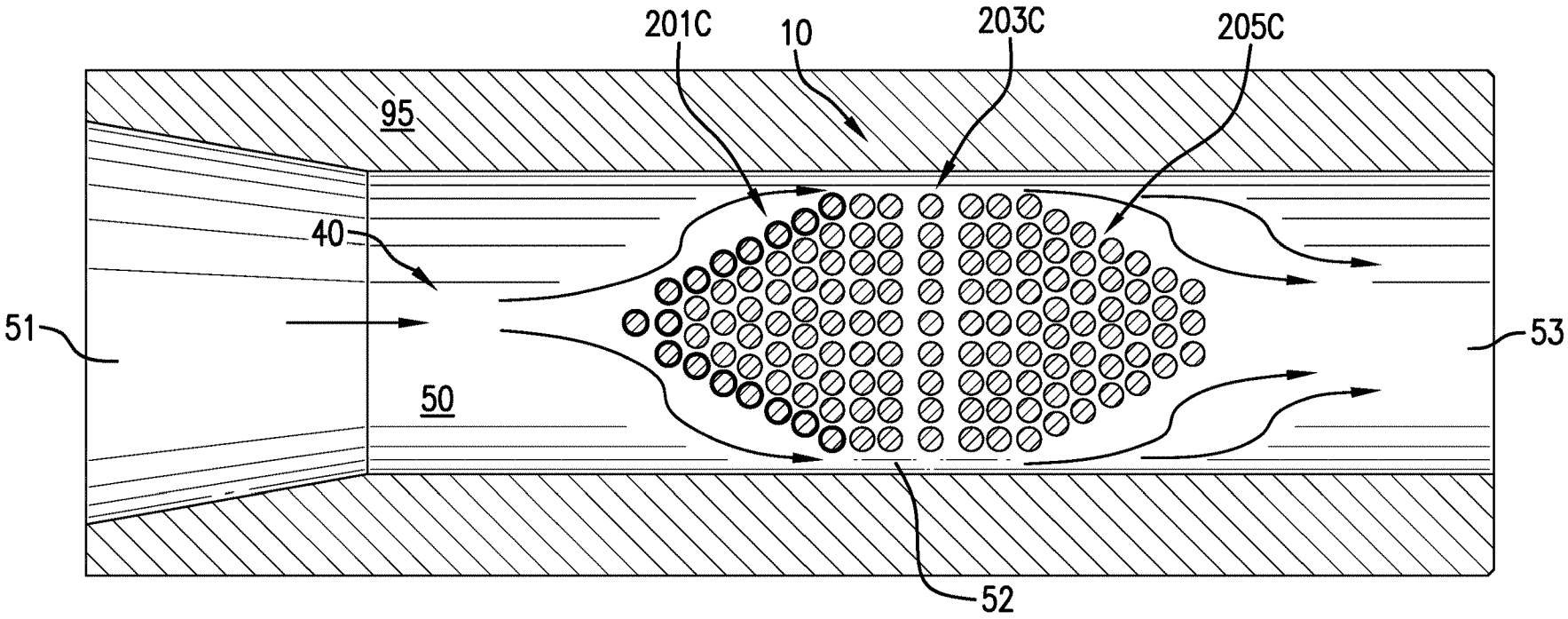
FIG. 8C is a schematic view of the inflow control device of FIG. 8A showing a flow of water therethrough.

FIG. 8C shows water 40 passing through the inflow control device 10. As the leading edge flow control structure 201C is hydrophobic, the water 40 glides over the leading edge flow control structure 201C such that most or all of the water 40 passes around the inflow control device 10, flowing through the constriction at the throat 52. A distance of the throat 52 may be set such that the water 40 experiences a Venturi effect.

Accordingly, referring to FIGS. 8A-8C, oil 30 may be organized and diffused by the inflow control device 10, while water 40 may see a Venturi effect, with increased drag compared to the oil 30. As such, the inflow control device 10 discourages higher water percentage fluids while allowing lower water percentage fluids to flow more freely. Thus, flow of fluid with high water concentration tends to flow slower than fluid with low water concentration.

Figure 9A:
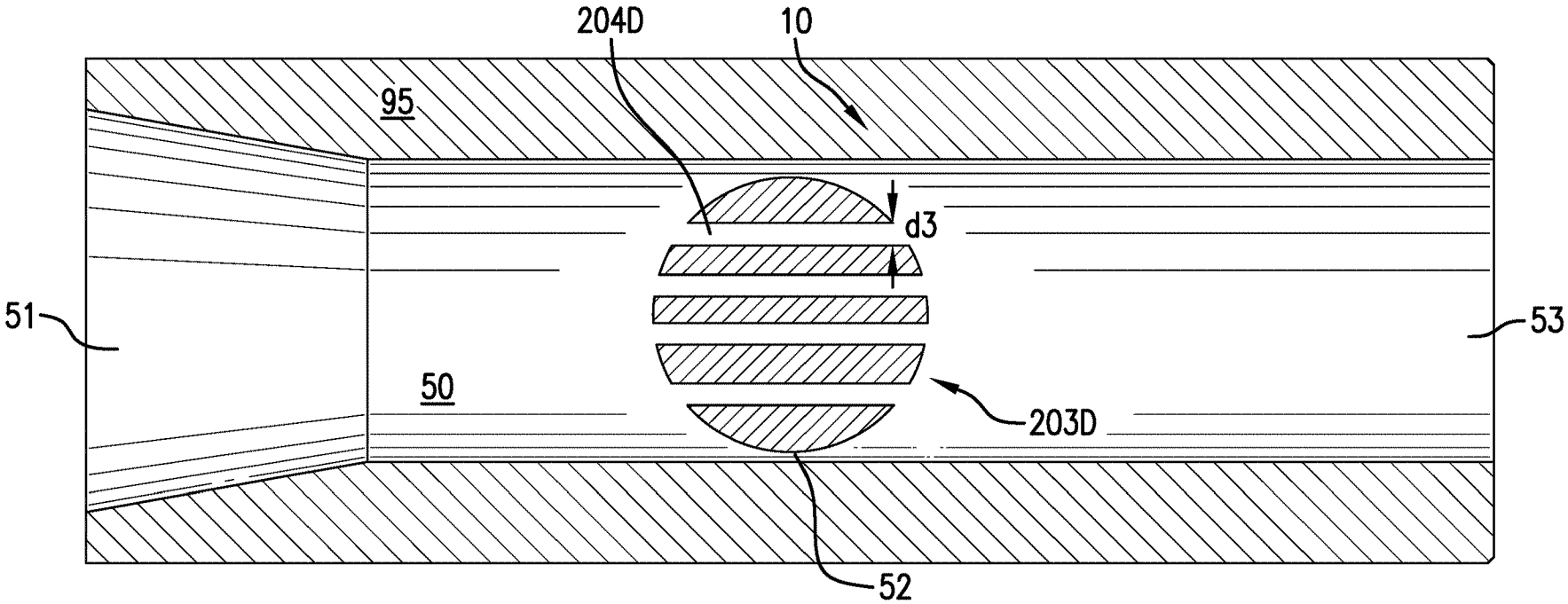
FIG. 9A is a schematic view of an inflow control device according to an embodiment.

Referring to FIG. 9A, an inflow control device 10 according to an embodiment is illustrated. The inflow control device 10 includes a flow control structure 203D having a plurality of oleophilic, hydrophobic channels 204D formed therethrough in the direction of flow of the flowpath 50. For example, the channels 204D may have a diameter of 1000 μm. According to one or more embodiments, the channels may have a diameter between 800 μm and 1200 μm. A throat 52 of the flowpath 50 is defined between an outer surface of the flow control structure 203D and an inner surface of the housing 95. According to one or more embodiments, the throat 52 is defined as an area of the flowpath 50 where the inflow control device 10 is disposed having a minimum flow area.

In the cross-section perpendicular to the flow direction of the flowpath 50, the flow control structure 203D may be a circular structure, and the channels 204D may be cylindrically-shaped extending in the flow direction from a leading edge surface of the flow control structure 203D to a trailing edge surface of the flow control structure 203D.

Figure 9B:
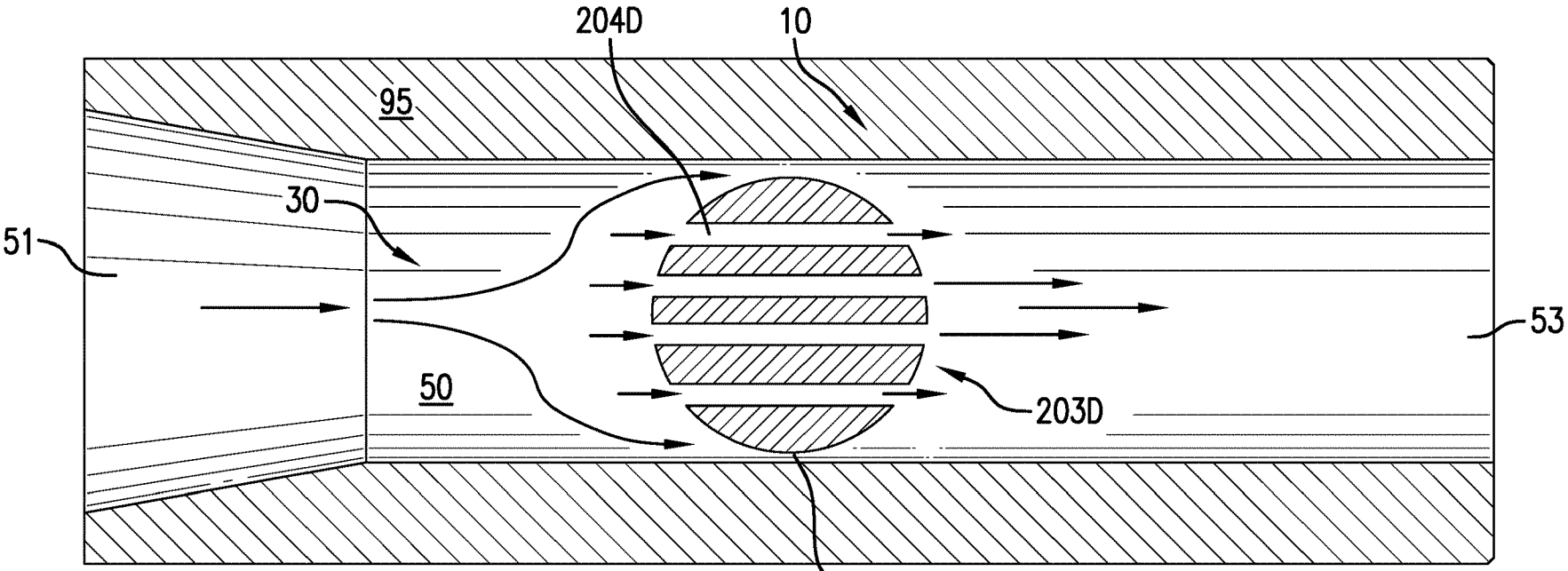
FIG. 9B is a schematic view of the inflow control device of FIG. 9A showing a flow of oil therethrough.

FIG. 9B shows oil 30 passing through the inflow control device 10. As the channels 204D formed in the flow control structure 203D are oleophilic, some portion of oil 30 passes through the channels 204D while the remainder passes around the flow control structure 203D such that, as shown in FIG. 9B, the oil 30 is organized and diffused while flowing through the inflow control device 10.

Figure 9C:
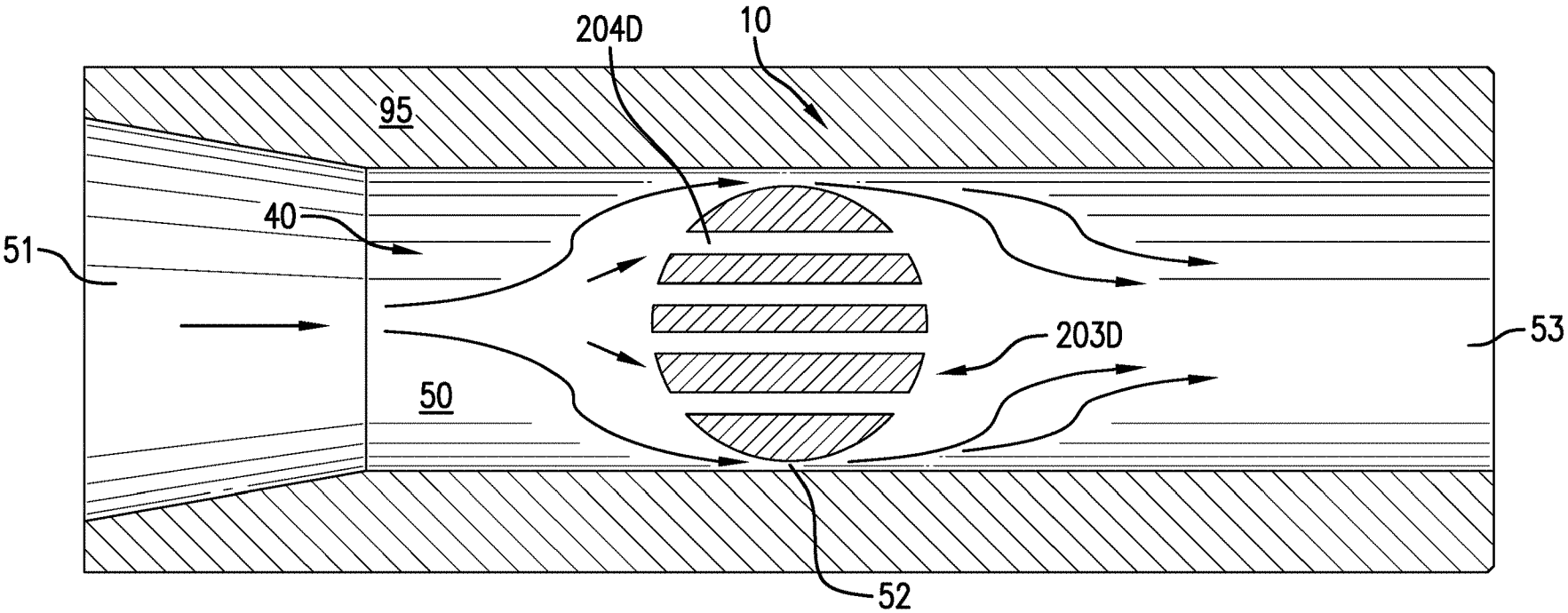
FIG. 9C is a schematic view of the inflow control device of FIG. 9A showing a flow of water therethrough.

FIG. 9C shows water 40 passing through the inflow control device 10. As the channels 203D formed in the flow control structure 203D are hydrophobic, the water 40 glides over inlets of the channels 204D such that most or all of the water 40 passes around the inflow control device 10, flowing through the constriction at the throat 52. A distance of the throat 52 may be set such that the water 40 experiences a Venturi effect.

Accordingly, referring to FIGS. 9A-9C, oil 30 may be organized and diffused by the inflow control device 10, while water 40 may see a Venturi effect, with increased drag compared to the oil 30. As such, the inflow control device 10 discourages higher water percentage fluids while allowing lower water percentage fluids to flow more freely. Thus, flow of fluid with high water concentration tends to flow slower than fluid with low water concentration.

In some of the embodiments set forth above, porous structures are discussed. Examples of porous materials that may form the porous structures include sintered metal powder filters, nickel foam, and porous ceramics.

Figure 10A:
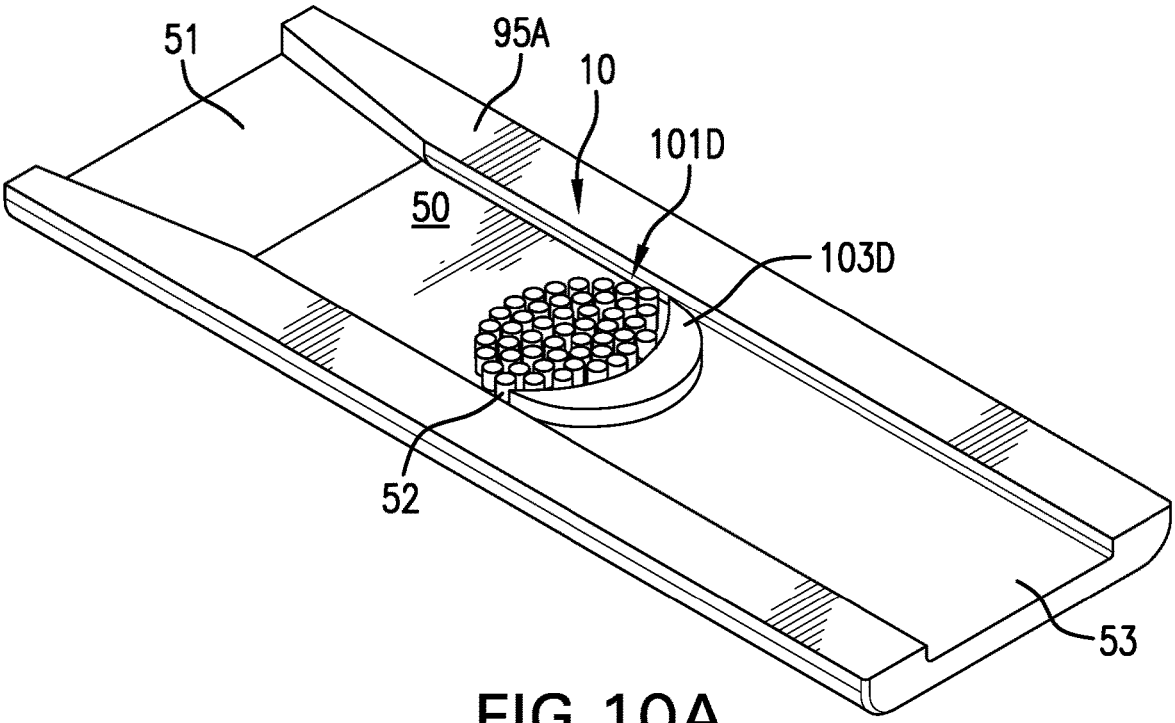
FIG. 10A shows a perspective view of a first partial housing that forms part of the housing and inflow control device shown in FIGS. 4A-4C.
Figure 10B:
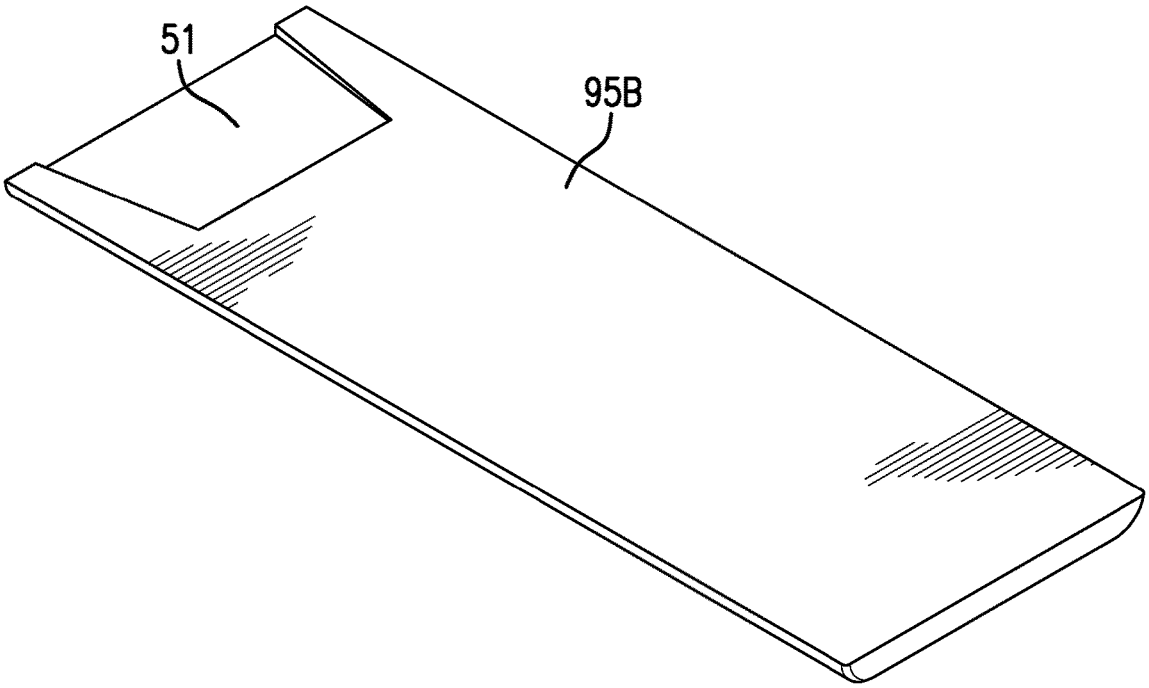
FIG. 10B shows a perspective view of a second partial housing that forms part of the housing and inflow control device shown in FIGS. 4A-4C.

FIGS. 10A and 10B show perspective views of a first partial housing 95A and a second partial housing 95B that are combined to form the housing 95 shown in FIGS. 4A-4C according to a non-limiting example. The second partial housing 95B may be disposed atop the first partial housing 95A to form the flowpath 50 and the inflow control device 10 therebetween. As shown in FIGS. 10A-10B, the flowpath 50 has a rectangular cross-section when viewed in a direction of flow of the flowpath 50, and the inflow control device 10 extends from a surface of the housing 95 defining the flowpath 50. The terminal end surfaces of the inflow control device 10 that face the second partial housing 95B may be flush with the second partial housing 95B such that there is no gap therebetween. That is, within a plane orthogonal to both the flow direction of the flowpath 50 and the plane shown in FIGS. 4A-4C, the inflow control device 10 and the flowpath 50 may have equal dimensions. The inflow control device 10 may be formed as a unitary structure with the first partial housing 95A.

While FIGS. 10A-10B show an embodiment of the inflow control device 10 shown in FIGS. 4A-4C, a person of ordinary skill in the art would understand that the embodiments of the inflow control device 10 shown in FIGS. 1A-3C and 5A-9C may be formed on a similar housing 95 such that the flowpath 50 is rectangular in a direction of flow thereof, and the inflow control device 10 extends similarly from a surface defining the flowpath 50.

While FIGS. 10A-10B show first and second partial housings 95A, 95B that are brought together to form the flowpath 50 and the inflow control device 10, the flowpath 50 and the inflow control device 10 may instead be formed in a unitary housing 95 that may be manufactured, for example, via 3D printing.

Furthermore, while FIGS. 10A-10B show the first and second partial housings 95A. 95B forming a rectangular flowpath 50 and a correspondingly shaped inflow control device 10 when viewed in the direction of flow of the flowpath 50, the housing 95 may instead be structured to have a cylindrical flowpath 50 formed therein such that the flowpath 50 may be circular when viewed in the direction of flow of the flowpath 50. In this case, the inflow control device may have an annular shape.

Figure 11:
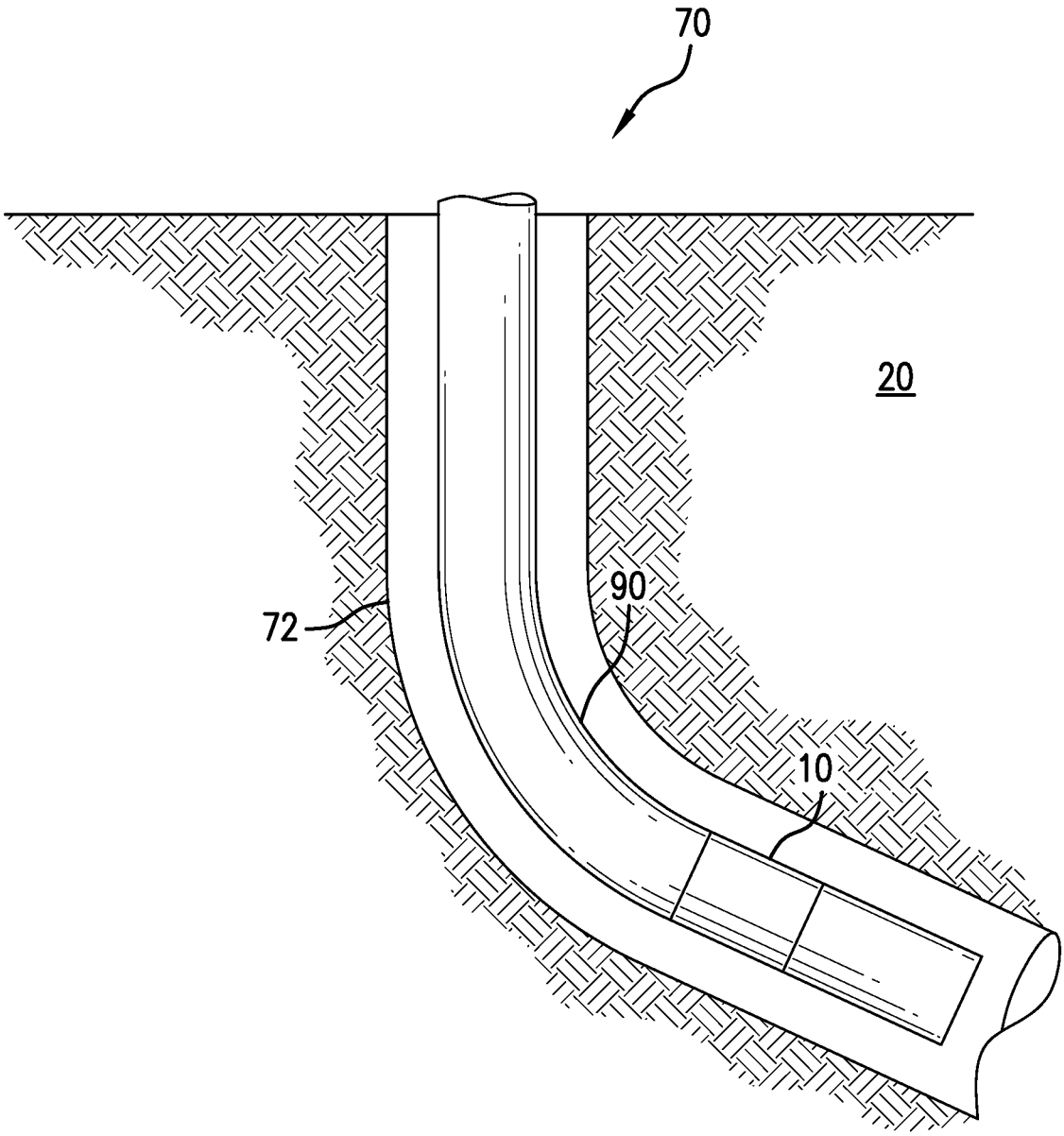
FIG. 11 is a view of a borehole system including the inflow control device according to one or more embodiments.

Referring to FIG. 11, a wellbore system 70 is illustrated. Wellbore system 70 includes a borehole 72 in a subsurface formation 20. Disposed within the borehole 72 is a string 90. An inflow control device 10 according to one or more embodiments is disposed within or as a part of the string 90.

Set forth below are some embodiments of the foregoing disclosure:

Embodiment 1: An inflow control device, including a first flow control structure that is porous and forms differing flowpaths for water and oil.

Embodiment 2: The inflow control device as in any prior embodiment, wherein the first flow control structure is oleophobic.

Embodiment 3: The inflow control device as in any prior embodiment, wherein the first flow control structure is hydrophilic.

Embodiment 4: The inflow control device as in any prior embodiment, further including a second flow control structure that is a non-porous structure disposed downstream of the first flow control structure.

Embodiment 5: The inflow control device as in any prior embodiment, further including a third flow control structure that is porous and forms differing flowpaths for water and oil disposed downstream of the second flow control structure.

Embodiment 6: The inflow control device as in any prior embodiment, wherein the third flow control structure is oleophobic and hydrophilic.

Embodiment 7: The inflow control device as in any prior embodiment, wherein the first flow control structure is cone-shaped.

Embodiment 8: The inflow control device as in any prior embodiment, wherein the third flow control structure is cone-shaped.

Embodiment 9: The inflow control device as in any prior embodiment, wherein the second flow control structure has a crescent-shaped cross-section.

Embodiment 10: The inflow control device as in any prior embodiment, wherein the first flow control structure comprises a plurality of stacked discs with pores formed therebetween.

Embodiment 11: The inflow control device as in any prior embodiment, wherein the first flow control structure is hydrophobic.

Embodiment 12: The inflow control device as in any prior embodiment, wherein the first flow control structure is oleophilic.

Embodiment 13: The inflow control device as in any prior embodiment, wherein the first flow control structure and the second flow control structure are a unitary structure.

Embodiment 14: The inflow control device as in any prior embodiment, wherein the unitary structure has a cross-section that is a circle, and the first flow control structure comprises a plurality of pores that, near an outer surface of the circle, extends further downstream than a center of the circle.

Embodiment 15: The inflow control device as in any prior embodiment, further including a second flow control structure that is a non-porous structure having a first portion disposed upstream of the first flow control structure and a second portion that is surrounded by the first flow control structure.

Embodiment 16: The inflow control device as in any prior embodiment, wherein the second non-porous structure is almond-shaped.

Embodiment 17: The inflow control device as in any prior embodiment, further including a second flow control structure that is oleophilic and hydrophobic disposed downstream of the first flow control structure that is cone-shaped, and a third flow control structure that is oleophilic and hydrophobic and cone-shaped disposed downstream of the second flow control structure.

Embodiment 18: The inflow control device as in any prior embodiment, wherein the first flow control structure comprises a plurality of oleophilic and hydrophobic channels extending from an upstream surface of the first control structure to a downstream surface of the first flow control structure.

Embodiment 19: A method of controlling flow including flowing a fluid from a source to a destination through the inflow control device as in any prior embodiment, and controlling flow via the first flow control structure such that oil flows through the inflow control device more easily than water.

Embodiment 20: A method of controlling flow including flowing a fluid from a source to a destination through the inflow control device as in any prior embodiment, and flowing a portion of water in the fluid through the first flow control structure to impinge on an upstream surface of the second flow control structure.

Embodiment 21: The method as in any prior embodiment, wherein oil in the fluid glides over an upstream surface of the first flow control structure so as to have idealized flow passing the inflow control device.

Embodiment 22: A wellbore system including a borehole in a subsurface formation, a string disposed in the borehole, and the inflow control device as in any prior embodiment disposed within or as part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow control device, comprising:
- a fluid inlet;
- a fluid outlet;
- a flowpath extending between the fluid inlet and the fluid outlet;
- a first flow control structure positioned surrounded by the flowpath that is porous and forms differing flowpaths for water and oil; and
- a second flow control structure positioned surrounded by the flowpath that is a non-porous structure disposed downstream of the first flow control structure,
- wherein the fluid inlet, the fluid outlet, the flowpath, the first flow control structure, and the second flow control structure are arranged on a common axis.

2. The inflow control device of claim 1, wherein the first flow control structure is oleophobic.

3. The inflow control device of claim 2, wherein the first flow control structure is hydrophilic.

4. The inflow control device of claim 1, further comprising:
- a first partial housing that defines the first flow control structure and the second flow control structure, and
- a second partial housing mounted on the first partial housing to define the fluid inlet, the fluid outlet, and the flowpath therebetween.

5. The inflow control device of claim 1, further comprising:
- a third flow control structure that is porous and forms differing flowpaths for water and oil disposed downstream of the second flow control structure.

6. The inflow control device of claim 5, wherein the third flow control structure is oleophobic and hydrophilic.

7. The inflow control device of claim 5, wherein the third flow control structure is cone-shaped.

8. The inflow control device of claim 1, wherein the first flow control structure is cone-shaped.

9. The inflow control device of claim 1, wherein the second flow control structure has a crescent-shaped cross-section.

10. The inflow control device of claim 1, wherein the first flow control structure comprises a plurality of stacked discs with pores formed therebetween.

11. The inflow control device of claim 1, wherein the first flow control structure is hydrophobic.

12. The inflow control device of claim 11, wherein the first flow control structure is oleophilic.

13. The inflow control device of claim 11, wherein the first flow control structure and the second flow control structure are a unitary structure.

14. The inflow control device of claim 13, wherein the unitary structure has a cross-section that is a circle, and the first flow control structure comprises a plurality of pores that, near an outer surface of the circle, extends further downstream than a center of the circle.

15. The inflow control device of claim 11, further comprising:

a second flow control structure that is oleophilic and hydrophobic disposed downstream of the first flow control structure that is cone-shaped, and a third flow control structure that is oleophilic and hydrophobic and cone-shaped disposed downstream of the second flow control structure.

16. The inflow control device of claim 1, wherein the first flow control structure comprises a plurality of oleophilic and hydrophobic channels extending from an upstream surface of the first control structure to a downstream surface of the first flow control structure.

17. A method of controlling flow comprising:

flowing a fluid from a source to a destination through the inflow control device of claim 1; and controlling flow via the first flow control structure such that oil flows through the inflow control device more easily than water.

18. A method of controlling flow comprising:

flowing a fluid from a source to a destination through the inflow control device of claim 1; and flowing a portion of water in the fluid through the first flow control structure to impinge on an upstream surface of the second flow control structure.

19. The method of claim 18, wherein oil in the fluid glides over an upstream surface of the first flow control structure so as to have idealized flow passing the inflow control device.

20. A wellbore system comprising:

a borehole in a subsurface formation;

a string disposed in the borehole; and the inflow control device of claim 1 disposed within or as part of the string.

21. An inflow control device, comprising:

a fluid inlet;

a fluid outlet;

a flowpath extending between the fluid inlet and the fluid outlet;

a first flow control structure positioned surrounded by the flowpath that is a porous and forms differing flowpaths for water and oil; and a second flow control structure positioned surrounded by the flowpath that is a non-porous structure having a first portion disposed upstream of the first flow control structure and a second portion that is surrounded by the first flow control structure, wherein the fluid inlet, the fluid outlet, the flowpath, the first flow control structure, and the second flow control structure are arranged on a common axis.

22. The inflow control device of claim 21, wherein the second non-porous structure is almond-shaped.

* * * * *